US006419343B1

(12) United States Patent
Taylor et al.

(10) Patent No.: US 6,419,343 B1
(45) Date of Patent: Jul. 16, 2002

(54) PRINTER AND METHOD FOR PRIMING AN INKJET PRINTHEAD

(75) Inventors: Christopher Taylor, Cely-en-Biere (FR); Richard H Lewis, Santa Maria de Palautordera Barcelona (ES); Antoni Murcia, San Diego, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/506,632

(22) Filed: Feb. 17, 2000

(30) Foreign Application Priority Data

Feb. 17, 1999 (EP) ..... 99103110

(51) Int. Cl.[7] ..... B41J 2/165
(52) U.S. Cl. ..... 347/35; 347/23
(58) Field of Search ..... 347/19, 22, 23, 347/25, 29, 30, 35, 87, 92

(56) References Cited

U.S. PATENT DOCUMENTS

| | | | | | |
|---|---|---|---|---|---|
| 4,558,326 | A | | 12/1985 | Kimura et al. | 347/30 |
| 4,599,625 | A | * | 7/1986 | Terasawa et al. | 347/87 |
| 4,870,431 | A | * | 9/1989 | Sousa et al. | 347/25 |
| 4,998,115 | A | * | 3/1991 | Nevarez et al. | 347/35 |
| 5,294,946 | A | * | 3/1994 | Gandy et al. | 347/3 |
| 5,325,111 | A | * | 6/1994 | Dietl | 347/30 |
| 5,543,826 | A | | 8/1996 | Kuronuma et al. | 347/23 |
| 5,627,572 | A | * | 5/1997 | Harrington, III et al. | 347/23 |
| 5,719,609 | A | | 2/1998 | Hauck et al. | 347/85 |
| 5,764,259 | A | | 6/1998 | Nakajima | 347/86 |
| 5,995,067 | A | * | 11/1999 | Terasawa et al. | 347/23 |
| 6,196,655 | B1 | * | 3/2001 | Hirasawa et al. | 347/25 |

FOREIGN PATENT DOCUMENTS

| | | | |
|---|---|---|---|
| EP | 0 857 576 A2 | 8/1998 | B41J/2/19 |
| JP | 59209878 | 11/1984 | B41J/3/04 |
| WO | WO 97/16315 | 5/1997 | B41J/2/175 |
| WO | WO 98/55318 | 10/1998 | B41J/2/175 |

* cited by examiner

*Primary Examiner*—Thinh Nguyen
*Assistant Examiner*—Blaise Mouttet

(57) ABSTRACT

A method and printer for priming an inkjet printhead without removing the printhead from a carriage of the printer, by the controlled delivery of a predetermined volume of gas to an air chamber within the printhead so that the air chamber expands within the printhead body causing an increase in the ink pressure within the printhead and thus a controlled flow of ink into the nozzles of the printhead. An ink puddle may be formed on the nozzle plate of the printhead during priming and subsequently drawn back into the printhead.

33 Claims, 25 Drawing Sheets

MAX NEG PRESSURE= −5 IN H20

PRINTER AND METHOD FOR PRIMING AN INKJET PRINTHEAD

The present invention relates to a method of priming an inkjet printhead without removing the printhead from a carriage of a printer and to a printer for priming a printhead and in particular, to priming a printhead having an air chamber connected to the atmosphere via a vent by the application of a positive pressure to the vent.

The present invention relates to the art of inkjet printing mechanisms whether of the thermal or piezo variety which may be included in a variety of different products including copiers and facisimile machines in addition to standalone printers either desktop mounted, portable or freestanding. Herein a freestanding printer will be used to illustrate the present invention. Printers of this type have a printhead carriage which is mounted for reciprocal movement on the printer in a direction orthogonal to the direction of movement of the paper or other medium on which printing is to take place through the printer. The printer carriage of a color printer typically has two or more, usually four, thermal ink jet printheads mounted thereon which may be removable. Each of the printheads contains or is attached to a supply of ink and occasionally it is necessary to prime one or more printheads by creating a pressure differential to force ink to flow into the ink delivery orifices or nozzles. Such priming for maintaining or recovering the operation of the printhead is becoming increasingly important as the printheads used in inkjet printers are required to have greater lifetimes. A number of printhead problems can be solved or alleviated by performing a priming operation on the printhead, for example dry or crusting ink, air bubbles or foreign particles may be removed from a nozzle or its associated firing chamber by priming. Also a condition known as local or global deprime (dependent on the number of nozzles affected), in which the continuity of ink supplied from the ink chamber of a printhead usually via narrow conduits to the nozzles is broken, can be corrected by priming the printhead.

A related but distinct aspect of printhead lifetime which is not addressed by the present invention is the undesirable accumulation of large quantities of air within the ink chamber of a printhead, known as warehoused air.

Printhead priming has usually previously been done by positioning a compliant seal around the printhead after the printhead carriage has been parked at a service station. In these systems, ink is drawn through the printhead nozzles by applying a negative pressure to the outside of the nozzle plates of the printheads to suck ink through the orifices. The negative pressure is generally maintained by pressing a compliant cap against the surface surrounding the nozzles to create a chamber closed to the atmosphere but connected to the negative pressure source. The source of the negative air pressure differential has been, among others, a collapsing air bellows, a remote pump connected by a fluid conduit or a movable diaphragm within a priming cap as described in U.S. Pat. No. 5,714,991. The use of negative pressure applied to the nozzle plate of a printhead has a number of disadvantages such as causing ink drawn out in this manner to foam which may lead to air bubbles blocking the nozzles and is also a technique over which it is difficult to establish precise control.

It is also known to apply a positive pressure to the ink within a supply line of a printhead served by a remote ink reservoir in order to force ink under pressure into the printhead and thus to prime the printhead, for example as described in U.S. Pat. No. 4,517,577 and GB 2304639. Such priming causes a significant flow of ink into the printhead through the supply line and out of the printhead through its nozzles and has a number of disadvantages. In addition to causing excessive ink waste and requiring this waste ink to be collected and stored in the printer, such significant flows of ink under pressure are hard to control accurately and may cause damage to the structures within a printhead for example in the vicinity of the nozzle plate, particularly in more modern complex printhead designs. In order to achieve sufficient control over the pressure and volume of ink pumped under pressure into a printhead an expensive ink displacement pump is required and the printer must additionally withdraw a controlled amount of ink from the printhead to reset the necessary negative pressure within the printhead.

Additionally, it is known to purge warehoused air from within the ink chamber of a printhead having an ink regulator and an air chamber by applying a positive air pressure to the air chamber so as to drive out warehoused air via either the nozzles, the ink inlet or a gas purge vent as described in EP 0857576 and U.S. Pat. No. 5,736,992.

According to a first aspect of the present invention, there is provided a method for priming an inkjet printhead without removing the printhead from a carriage of a printer, the printhead having a body comprising an ink chamber in fluid communication with a plurality of ink ejection nozzles in a nozzle plate and a variable volume air chamber coupled to said ink chamber and having a vent which is in gaseous communication with ambient atmosphere, the method comprising the steps of moving the carriage to a service area within the printer, interfacing a source of gas to the vent of the air chamber of the printhead, and delivering a predetermined controlled volume of gas from said gas source at a pressure above ambient atmospheric pressure to the air chamber so that the air chamber expands within the printhead body causing an increase in the pressure within the ink chamber and thus a controlled flow of ink into the nozzles of the printhead to prime the printhead. It has been discovered by the present Applicant that the controlled delivery of a predetermined volume of air to the air chamber of a known design of printhead ink regulator while the printhead is mounted within the printer can be utilised to effectively prime the printhead in a manner which is highly controllable and which does not cause damage to the printhead and thus can be repeated many times during the lifetime of the printhead.

Preferably, during priming of the printhead a controlled volume of ink passes through the nozzles onto the outside of the nozzle plate and the majority of said ink is drawn back through the nozzles and into the printhead. This flowback of ink into the printhead has been found to be effective in resolving a number of problems with printheads which are difficult to resolve without such flowback of ink. Furthermore, the quantity of waste ink in greatly reduced.

Advantageously, the ink chamber comprises an ink regulator through which the ink chamber receives ink at a pressure above ambient atmospheric pressure from a remote ink reservoir and the preferred priming method controls the ink delivery pressure during priming of a printhead so that substantially no ink flows into the printhead from the ink reservoir during priming. Thus preferably the increase in pressure within the printhead which causes priming of the printhead is due substantially only to the air delivered to the printhead.

According to a second aspect of the present invention, there is provided a printer in which an inkjet printhead may be primed without removing the printhead from a carriage of the printer, the printer comprising a source of gas capable of delivering a predetermined controlled volume of gas at a pressure above ambient pressure, a carriage for holding at least one printhead and having coupling means for coupling a vent on the printhead to the source of gas, and a controller for controlling the priming of a printhead by the application of a controlled predetermined volume of gas to a printhead mounted in the carriage.

Preferably, the controller of the printer comprises storage means for storing priming data for use in priming an identified printhead.

More preferably, the stored priming data comprises data affecting at least one of the following parameters for priming the identified printhead 1) a volume of gas supplied to the printhead, 2) a duration for which a pressure above ambient is applied to a printhead, 3) a temperature to which the printhead should be heated prior to priming, or 4) an ink supply pressure of a remote ink reservoir in fluid communication with the printhead.

Most preferably, priming data is stored for a plurality of printheads and the priming data for at least two of the printheads is different.

Further advantages and objects of the present invention will be appreciated from specific embodiments of the present invention which will now be described by way of example only and with reference to the following drawings in which.

In describing preferred embodiments of the present invention details of the preferred mechanism for applying a positive air pressure to a printhead in order to prime the printhead will first be described. Subsequently, the structure of a preferred printhead for use with embodiments of the invention will be described and finally the servicing and priming of a printhead according to preferred embodiments will be described.

Figure 1:
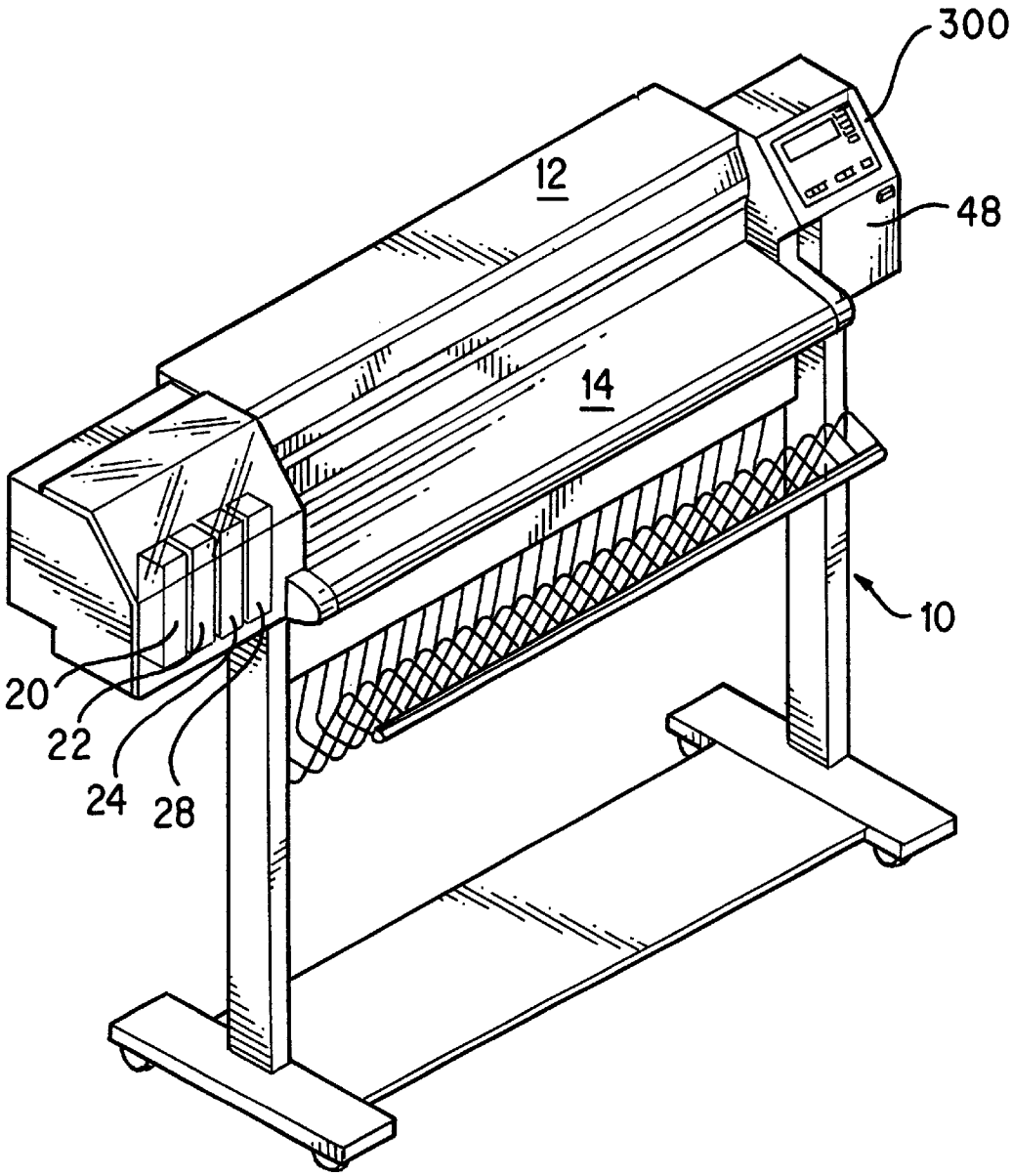
FIG. 1 is a perspective view of a large format printer in which the present invention is useful.

FIG. 1 shows a large format printer 10 of the type which includes a transversely movable printhead carriage enclosed by a cover 12 which extends over a generally horizontally extending platen 14 over which printed media is discharged into a catcher basket. At the left side of the platen are four removable ink reservoirs 20, 22, 24, 26 which, through a removable flexible tube arrangement to be described, supply ink to four inkjet printheads mounted on the moveable carriage.

Figure 2:
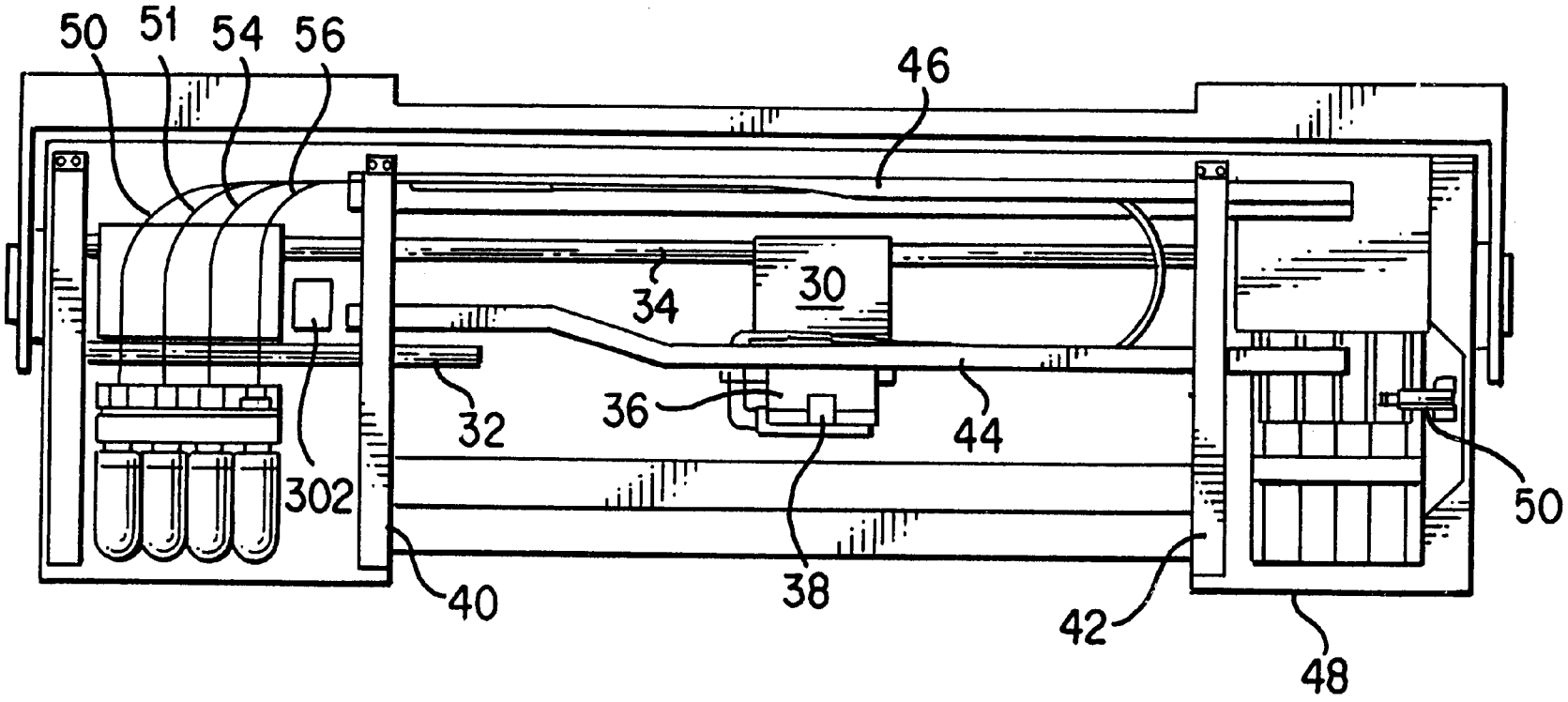
FIG. 2 is a top plan view of the printer with its cover removed to show the automatic priming pump and service station at the right end of the path of travel of the printhead carriage.
Figure 9:
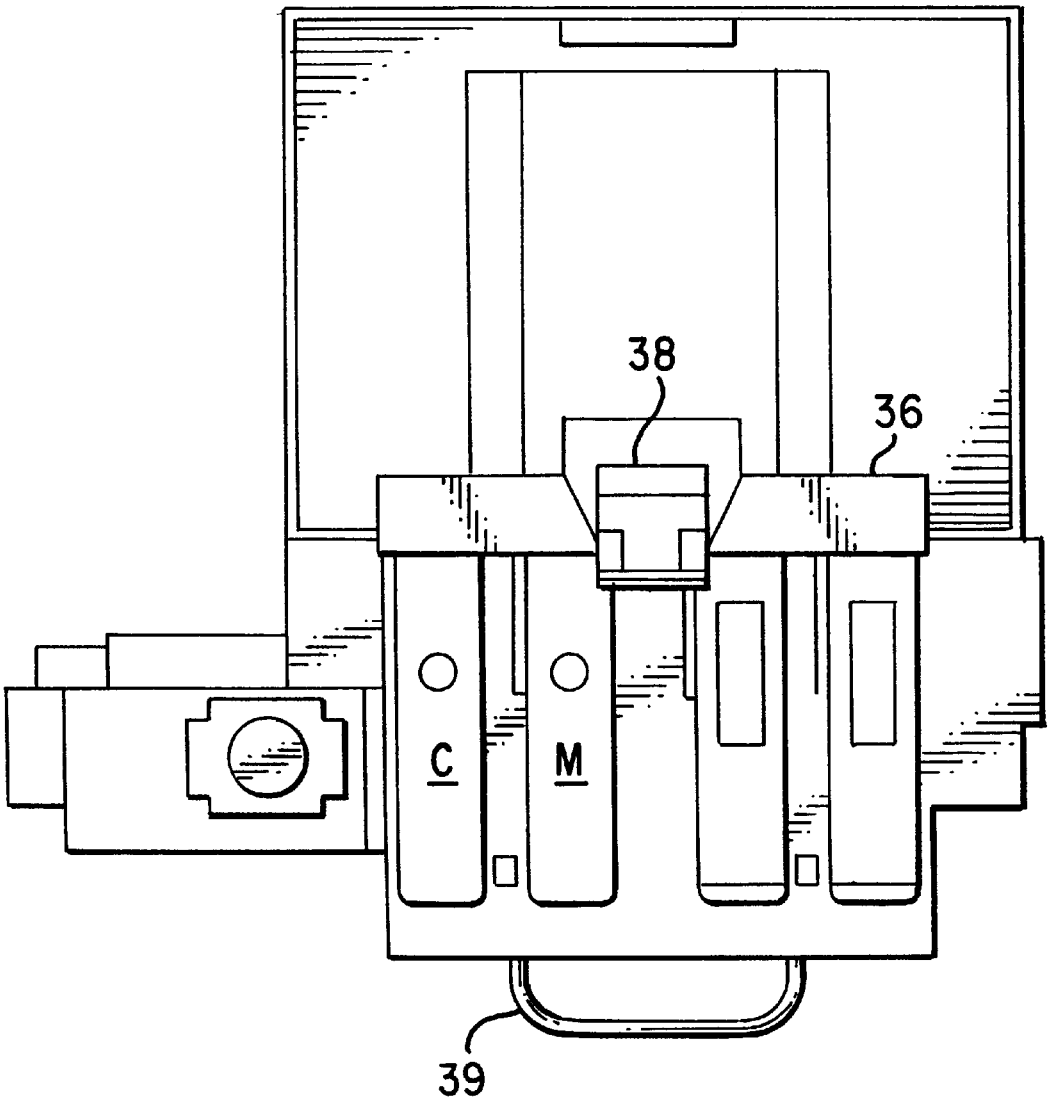
FIG. 9 is a top plan view of the carriage with printheads installed in two stalls and the cover in raised position.
Figure 10:
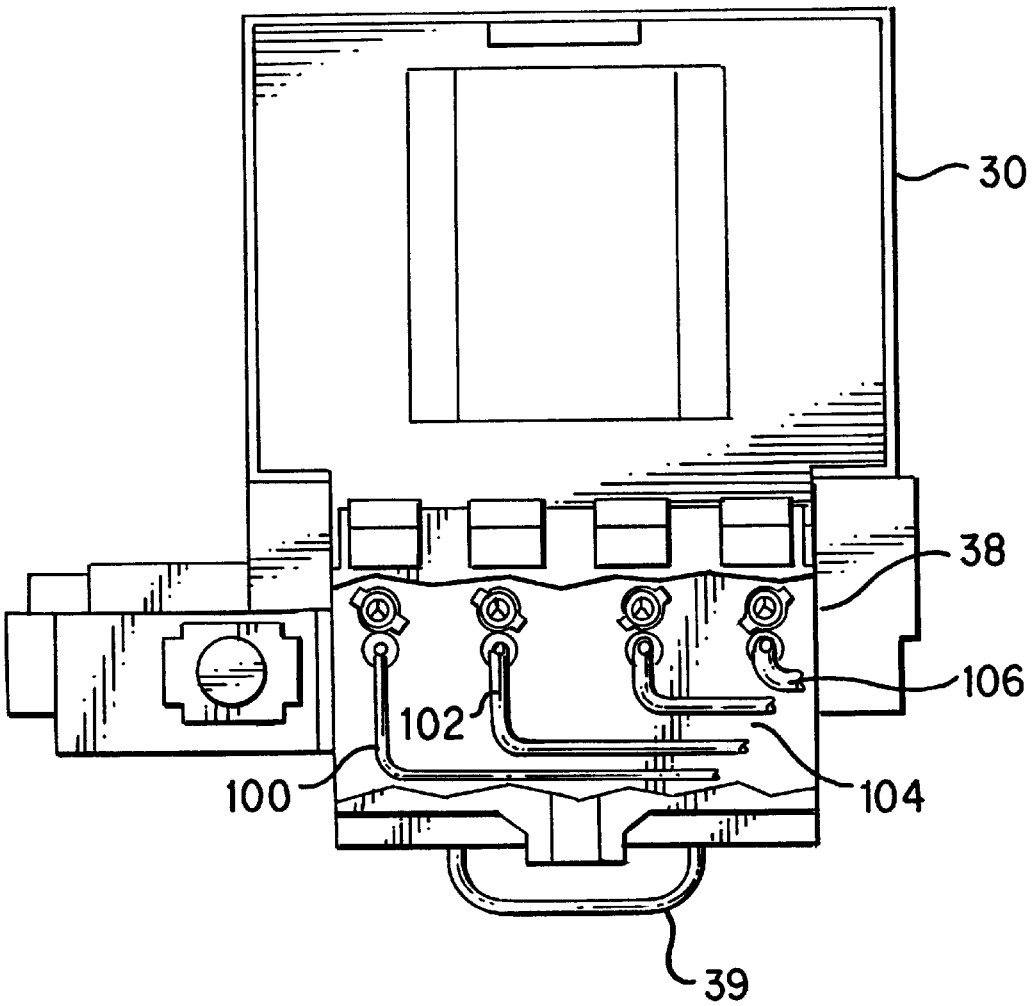
FIG. 10 is a plan view of the carriage cover partly broken away showing air passageways therein.

In the plan view of FIG. 2 in which the carriage cover 12 has been removed, it is seen that the printhead carriage 30 is mounted on a pair of transversely extending slider rods or guides 32, 34 which in turn are affixed to the frame of the printer. Also affixed to the frame of the printer are a pair of tube guide support bridges 40, 42 from which front and rear tube guides 44, 46 are suspended. The printhead carriage 30 has a pivotal printhead hold down cover 36 fastened by a latch 38 at the front side of the printer which securely holds four inkjet printheads, two of which are shown in FIG. 9 in place in stalls C, M, Y, K on the carriage. The front tube guide 44 is angled near the left bridge support 40 to provide clearance for opening the printhead cover 36 when the carriage is slid to a position proximate the left side of the platen 14 so that the printhead hold down cover 36 can be easily opened for changing the printheads.

A flexible ink delivery tube system conveys ink from the four separate ink reservoirs 20, 22, 24, 26 at the left side of the printer through four flexible ink tubes 50, 52, 54, 56 which extend from the ink reservoirs through the rear and front tube guides 44, 46 to convey ink to printheads on the carriage 30. The ink tube system may be a replaceable system.

Figure 8:
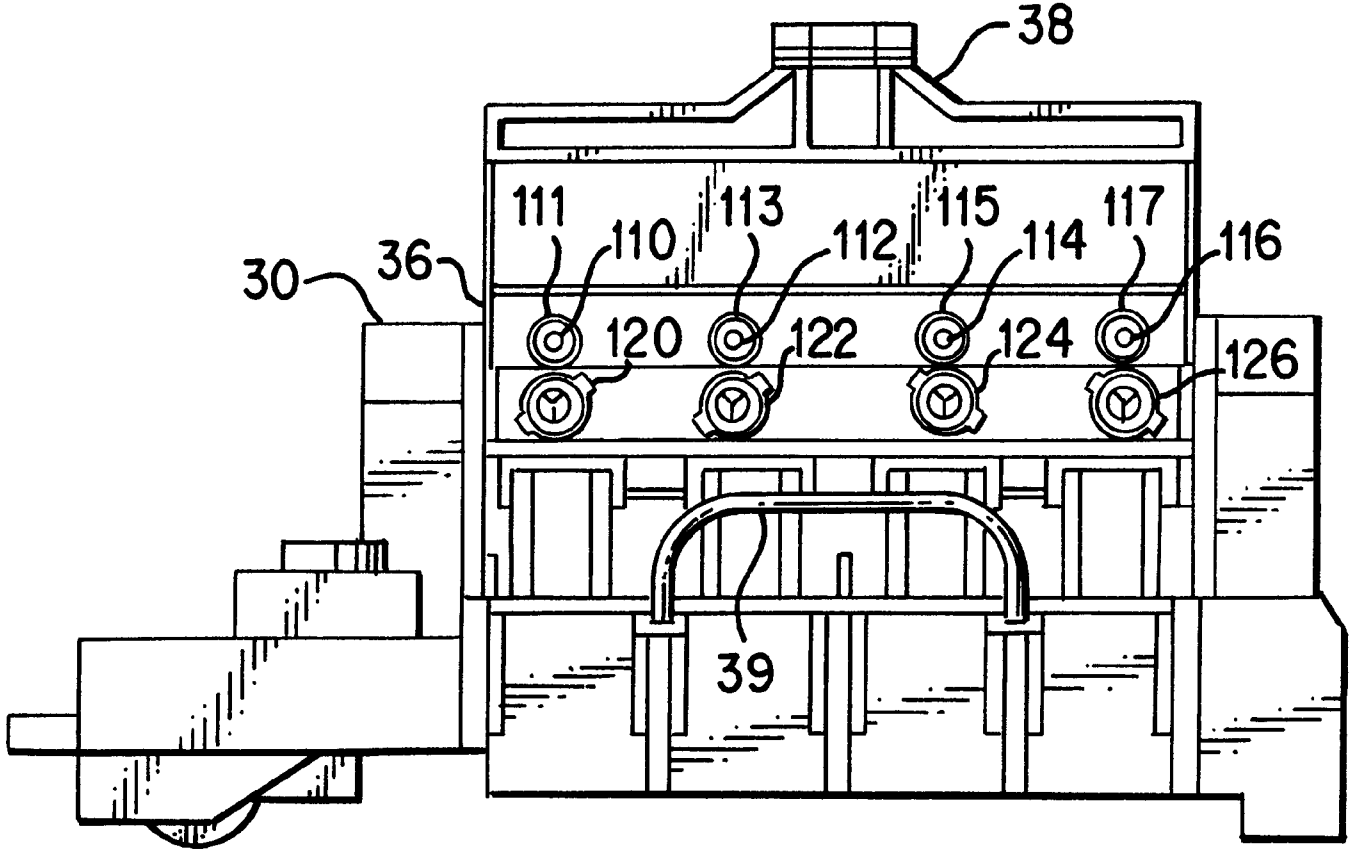
FIG. 8 is a front elevation view of the carriage showing the printhead cover in the raised position.

At the right side of the printer is a printhead service station 48 at which the printhead carriage 30 may be parked for cleaning and priming the printheads. The printhead service station 48 is comprised of a plastic frame mounted on the printer adjacent the right end of the transversely extending path of travel of the printhead carriage 30. The printhead carriage 30 (FIGS. 8 and 9) includes four stalls C, M, Y, K which respectively receive four separate printheads containing colored ink such as cyan, magenta, yellow and black. The service station 48 also includes four separate servicing stalls C, M, Y, K which may be provided on a drawer which is moveable forwardly and rearwardly of the printer. The servicing stalls each include a spittoon to capture any ink that may be discharged by the printheads during servicing. The moveable drawer construction of the servicing station forms no part of the present invention.

A printhead servicing pump 50 is mounted on the upper end of a pump positioning arm 80. A gear enclosure frame 60 is affixed to the right sidewall of the frame of the service station 48 and is spaced therefrom to provide a pocket containing a speed reduction gear mechanism which positions the arm 80 and thus the pump 50 with respect to the printhead carriage 30. The positioning arm 80 is mounted for movement on a pivot axis 82 extending between the right sidewall of the service station frame and the gear enclosure frame 60. An arm positioning electric step motor 90 rotates a drive gear 92 thereon which is engaged with the teeth of a large driven gear 94 connected on a common shaft to a small driven gear 96 having teeth which mesh with an arcuate arm positioning gear 98 formed on the pump positioning arm 80 to move the arm through an angle of slightly less than 90°. Movement of the arm 80 positions the pump at various locations along an arc centered on the pivot axis 82 of the arm to align a pump outlet 52 with the inlet end of one of four air conduits 100, 102, 104, 106 arcuately positioned on the side of a pivotally mounted printhead holddown cover 36 on the printhead carriage 30.

The four air conduits each 100, 102, 104, 106 are each sized to have a substantially equal volume and extend from the inlet ends at the side of the hold down cover 36 internally of the cover and terminate in downwardly directed (when the cover is closed) fluid outlets 110, 112, 114, 116 on the underside of the printhead holddown cover. The air outlets each have a compliant seal 111, 113, 115, 117 therearound which mates with corresponding air inlet ports on the top surfaces of the four printheads when positioned in their respective stalls in the printhead carriage. Also shown on the underside of the printhead holddown cover 36 are spring loaded printhead positioners 120, 122, 124, 126. It will be seen that the printhead holddown cover is pivotally connected to the carriage and fastened in its closed or printhead holddown position by a finger latch 38 and retainer 39.

The air pump 50, which may be removably affixed to the upper end of the positioning arm 80 or permanently attached thereto as desired, comprises an open ended cylinder 51 in which an elongated piston 52 having a pair of spaced piston alignment discs 53, 54 or collars slideably engageable with the inner wall of the cylinder is received. The piston 52 is biased outwardly of the cylinder by a compression spring 55 which is seated at one end against a spring seat 56 in the pump cylinder and which is seated at its other end against a collar 57 surrounding the inner end of a hollow piston stem 58 having an elongated axial passageway 59 therethrough. A compliant seal 61 is seated against the inner piston alignment disc 54 and slideably engages the inner wall of the cylinder to provide an air seal therebetween. The walls of the seal 61 engage the cylinder 51 at an angle so that the seal 61 unidirectionally holds a positive pressure within the air chamber 68 when the piston 52 moves to the right, but does not hold a vacuum when piston 52 moves to the left. The cylinder is closed by a cover 63 attached to the outer wall of the cylinder by one or more fasteners 65, the construction of which is not relevant to the present invention. Alternatively, the cover may be threadedly affixed to the cylinder. The piston 52 has an enlarged collar 67 at its outer end on which a compliant gasket 69 is affixed for engaging the side wall of the printhead holddown cover 36 and providing an air seal between the outlet 52 of the piston and the side wall of the printhead holddown cover 36 during positioning of the carriage against the piston at the service station.

Servicing of the printheads on the printhead carriage is accomplished in part by positioning the pump 50 for alignment with the air passageway 102, 104, 106, 108 in the printhead holddown cover which conveys air to the printhead to be serviced. Movement of the carriage 30 into the service station 48 with the pump so positioned causes the carriage to engage the compliant gasket 69 at the outlet of the pump with continued movement of the carriage moving the pump piston 52 to the right into the cylinder to discharge air from the air chamber 68 in the cylinder through the central passageway 59 in the piston to thus provide a source of positive air pressure to the printhead which is utilised to prime the printhead as will be described in greater detail below. The nozzle plates of the printheads C, M, Y, K may thus be primed by means of a positive air pressure supplied by the pump 50. The air pressure supplied by the pump need not contact the ink in the printheads and in fact should not do so to avoid introducing air which must be warehoused in the printhead body. Accordingly, a printhead configuration in which ink in the printhead is contained in a chamber having a volume which can be reduced by application of air pressure to another chamber in the printhead is preferred and will be described in greater detail below. Travel of the carriage away from the pump 50 as it leaves the service station 48 extracts the air which has been previously forced into the printhead cover. If some of the air introduced under pressure to the printhead has escaped during the process, the pump may apply an undesired amount of vacuum to the printhead. The pump design allows the pressure to be clipped at a small negative pressure of approximately −5.0 inches of water to avoid creating a vacuum before damage is done to the printhead. The seal between the pump outlet and the passageway in the printhead holddown cover is broken after the pump piston has traveled under the bias of the spring 55 to the end of its stroke. Thus any backpressure within the printhead necessary for its correct functioning should remain unaffected by the priming operation.

Figure 5:
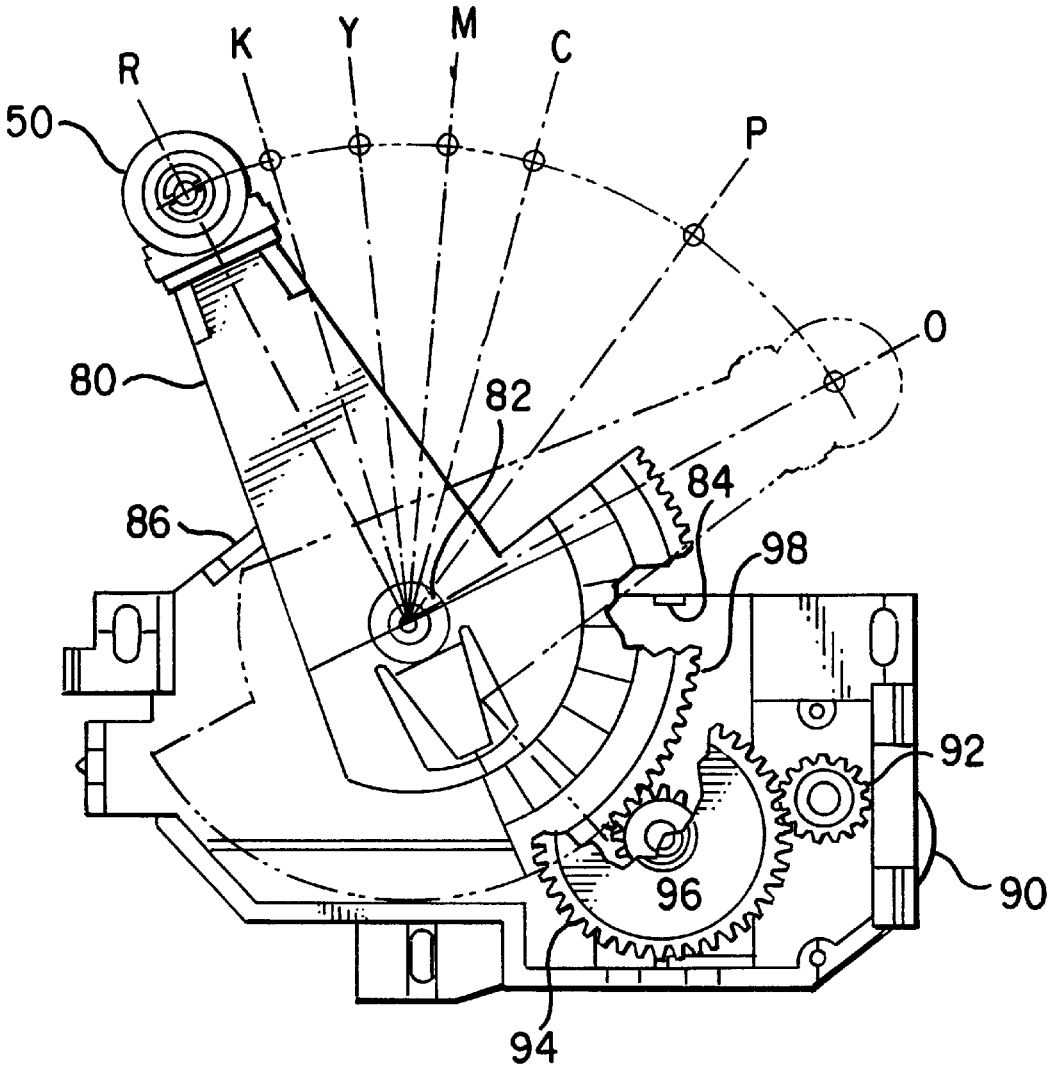
FIG. 5 is a cross-sectional elevation view taken at line 5—5 in FIG. 3, of the mechanism for moving the pump to selected positions to prime selected printheads.
Figure 6:
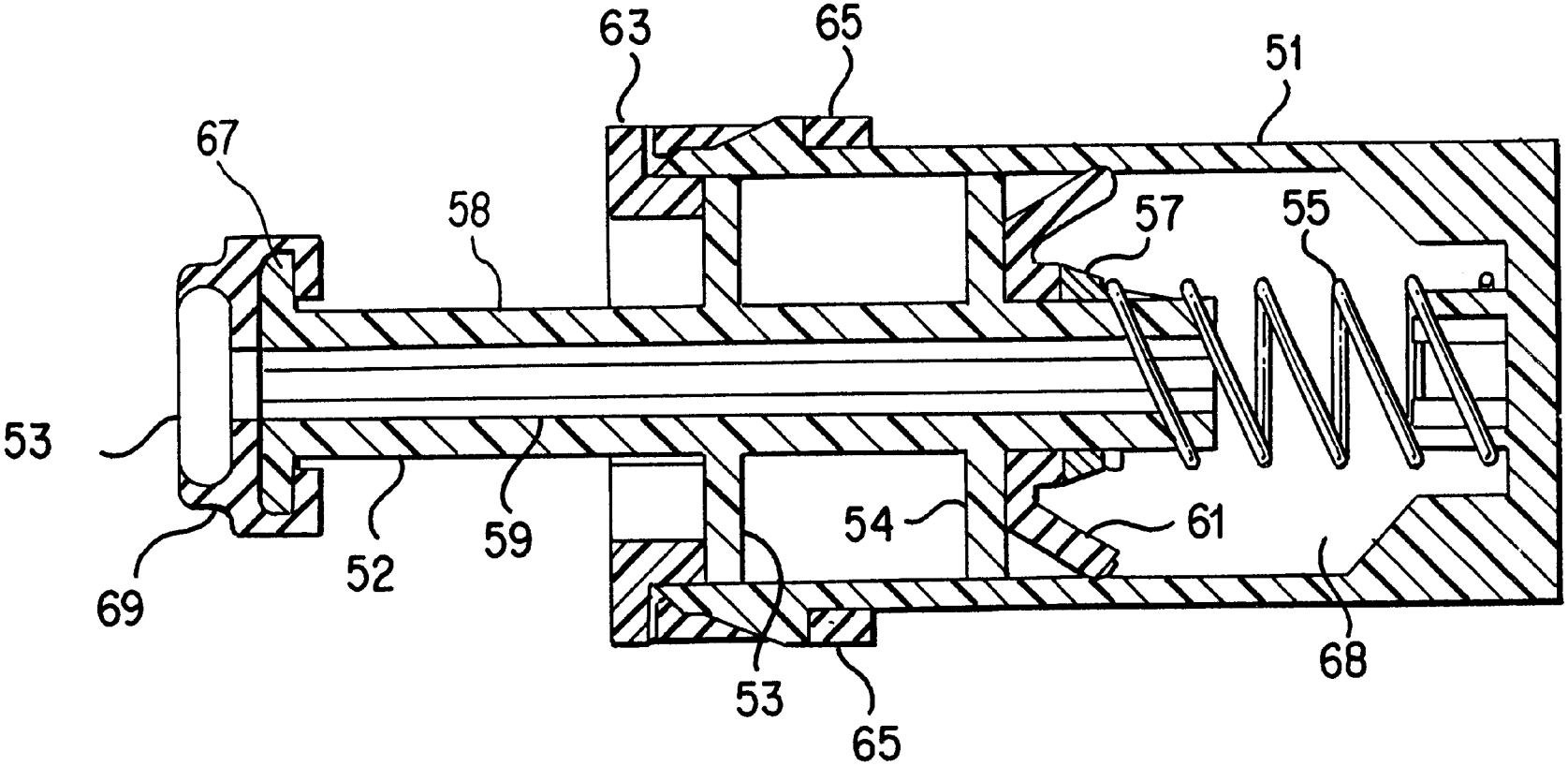
FIG. 6 is a cross-sectional elevation view through the pump.
Figure 7:
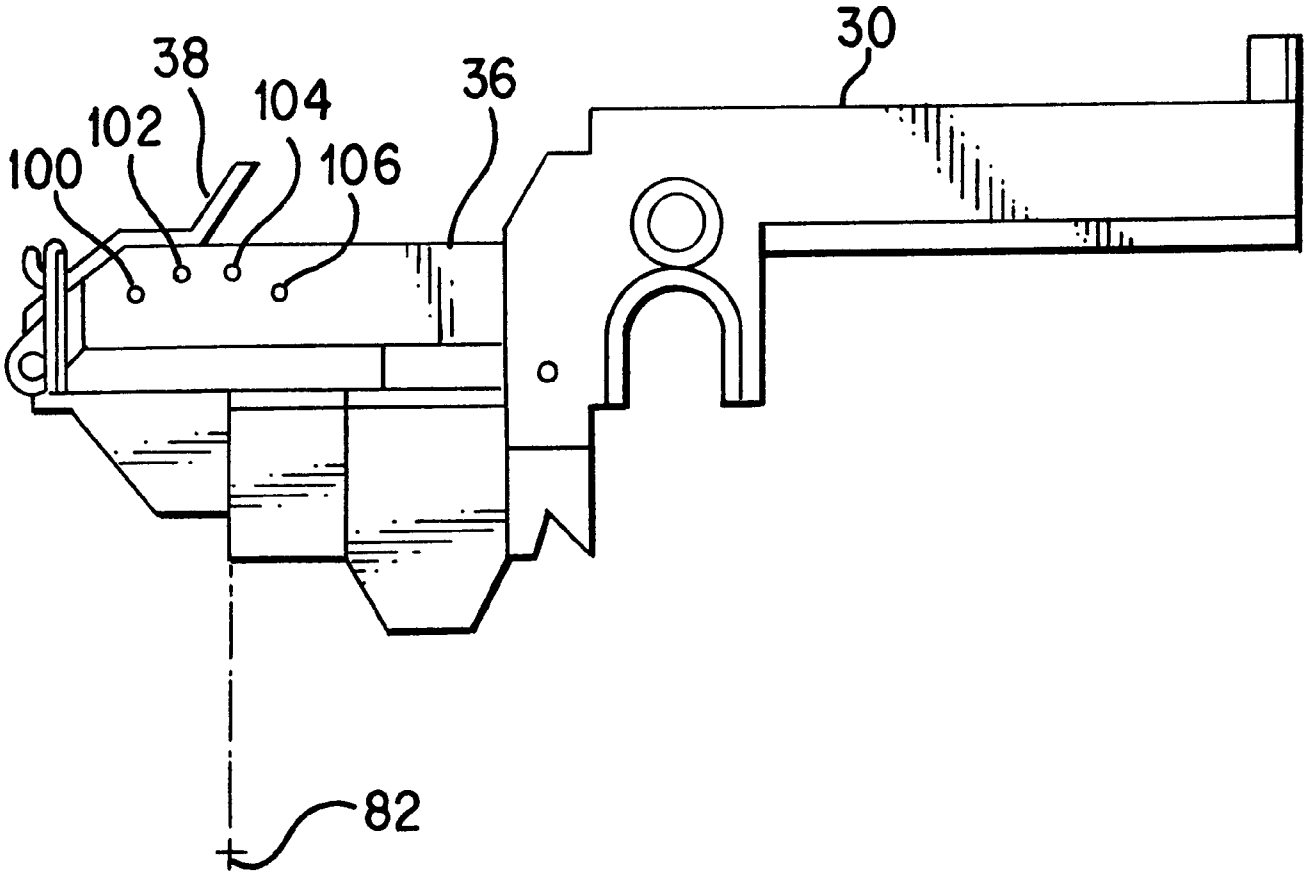
FIG. 7 is a right side elevation view of the printhead carriage with cover in the closed position.

The pump 50 is arcuately postionable as best seen in FIG. 5 anywhere between a rest position O and a reference position R which are defined by stops 84, 86 on the gear housing which are engaged by the sides of the positioning arm 80. Positions of the arm for delivery of air by the pump to the cyan, magenta, yellow and black ink printhead conduits 100, 102, 104, 106 on the printhead carriage holddown cover 36 are shown in FIG. 5 at positions preferably spaced by approximately 6° degrees from each other.

The stepper motor 90 preferably steps the gear 92 at 3.75°/half-step and the gear train preferably provides a 30:1 reduction between the stepper motor 90 and the gear 98 on the pump positioning arm 80.

Figure 3:
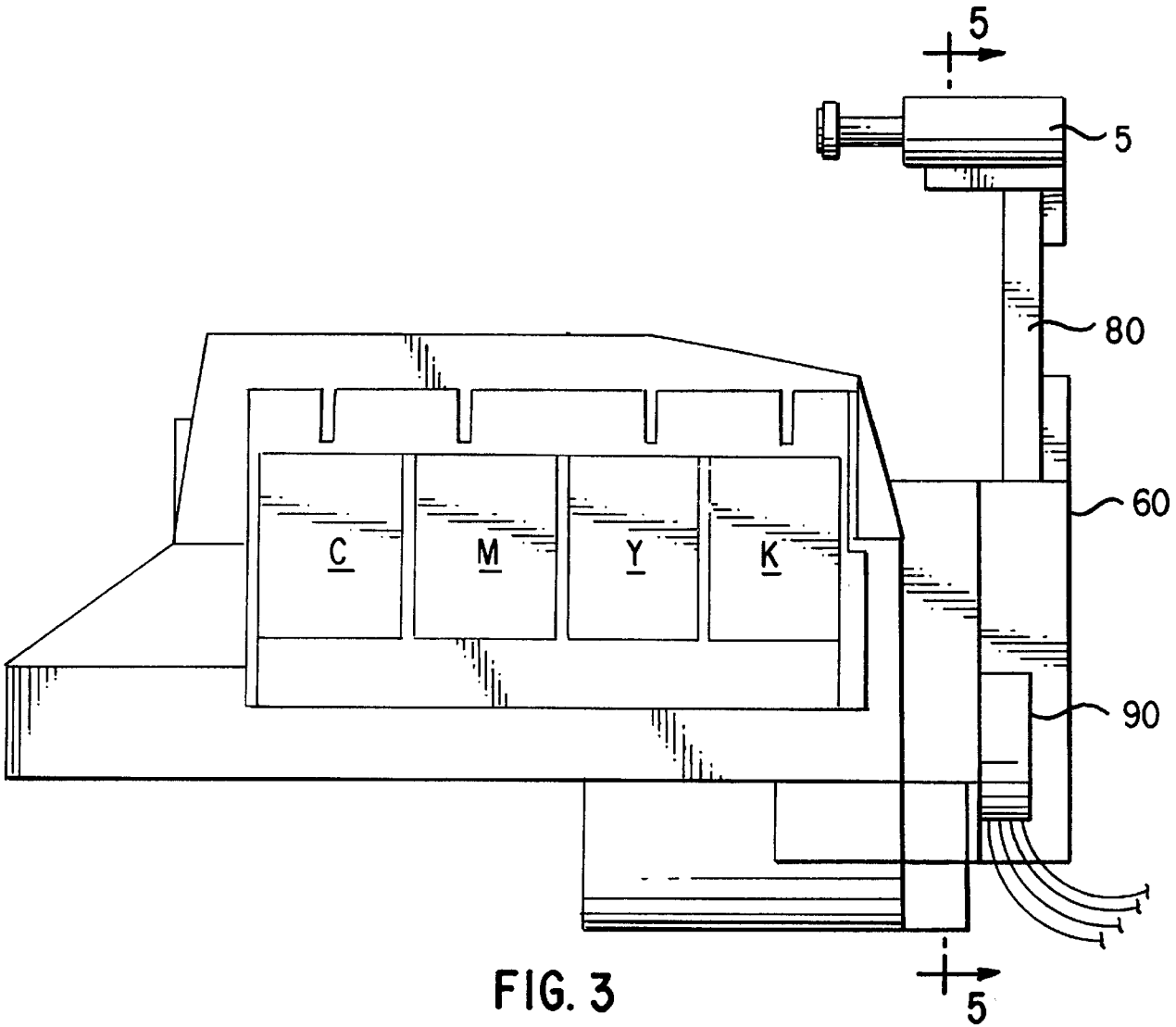
FIG. 3 is a front elevation view of the service station and priming pump.

The hard stops 84, 86 which define the limits of travel of the pump positioning arm are preferably placed at 84° from one another. For each printhead servicing cycle, the pump 50 is moved from the parking or rest position O in which the arm 80 engages the parking hard stop 84 to the reference position R in which the positioning arm engages the reference stop 86. The reference stop 86 is positioned closer than the parking or rest stop 84 to the functional angular positions K, Y, M, C in which the pump 50 engages the cyan, magenta, yellow and black printhead conduits 100, 102, 104, 106 on the carriage holddown cover. After movement of the pump positioning arm from the rest position O to the reference position R, the arm is then moved in a reverse (clockwise as seen in FIG. 3) direction to the preliminary position P. The stepper motor 90 then moves the pump positioning arm 80 in the original direction (counterclockwise in FIG. 3) to position the pump 50 in alignment with the desired functional location C, M, Y or K for connection to the related conduit 100, 102, 104, 106. This movement is performed to assure that, due to backlash, the same gear tooth face set that is used to move the pump positioning arm against the reference hard stop 86 is used to complete the accurate positioning of the pump 50 in the selected functional position.

The hard stops 84, 86 are integrally formed with the pump positioner housing. This design sacrifices a small amount of positional accuracy in the nominal position of the pump 50 but decouples the hard stop function from the vertical adjustment of the positioner housing. An over-stepping algorithm is used to ensure that the pump positioning arm 80 has contacted the reference hard stop 86. The over-stepping algorithm includes margin for both backlash and possible lost steps.

All functional angles are placed at even multiples of the nominal angular resolution. This is done to ensure that there are no pump positioning errors because an odd step total for a half-stepping algorithm is, by definition, less stable than an even step total.

Figure 4:
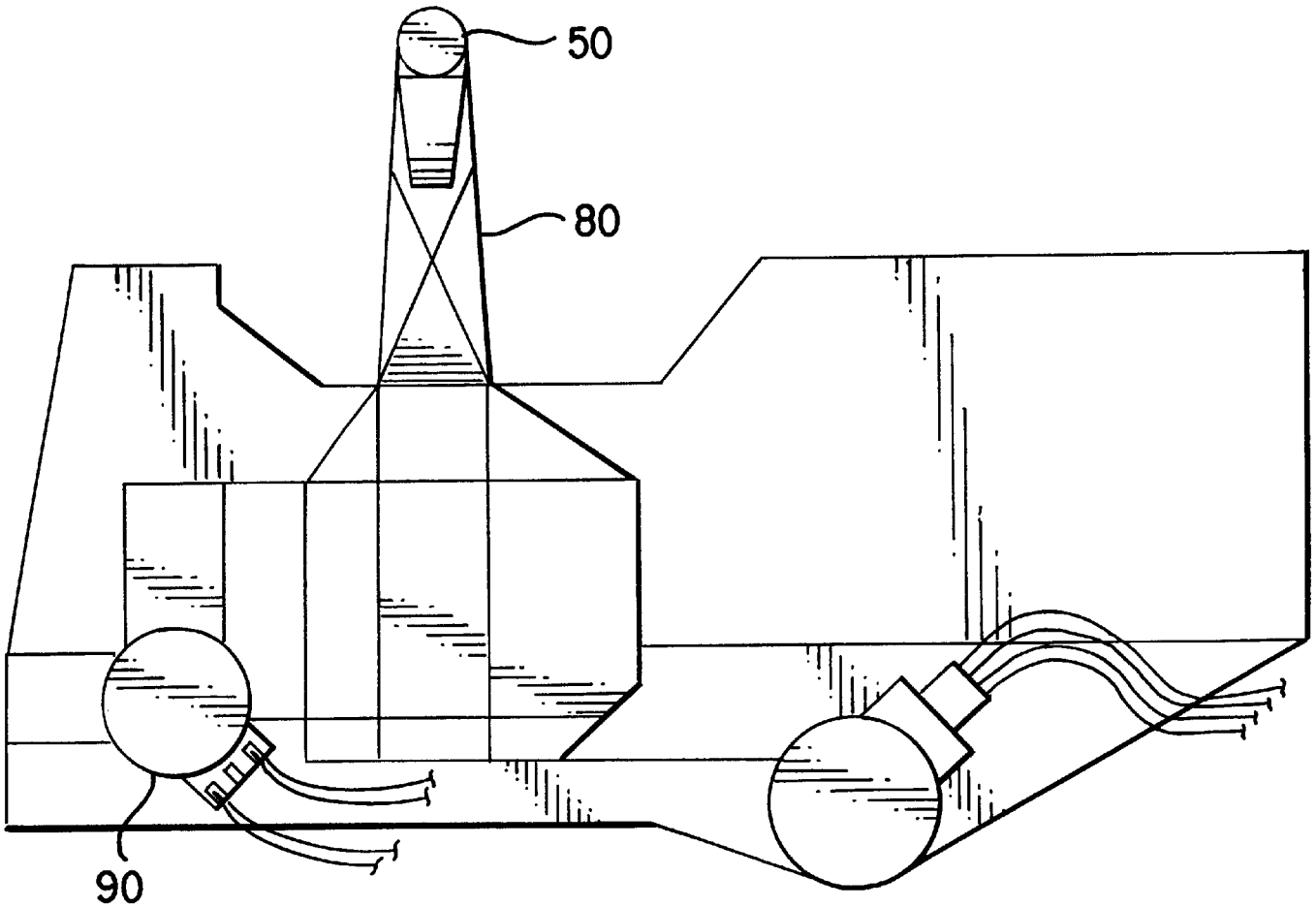
FIG. 4 is a right side elevation view of the service station and priming pump.

The inlets on the printhead holddown cover to the conduits 100, 102, 104, 106 are placed at angles of 6° from one another and are centered around a vertical line which extends through the axis 82 of rotation of the pump positioning arm 80 and are located at the same radius as the outlet of the pump 50. The axis 82 of rotation of the positioning arm 80 is placed at a maximum reasonably feasible radius from the inlets to the conduits 100, 102, 104, 106 to minimize the vertical distance (FIG. 4) between the inlets to facilitate the design of the holddown cover 36.

The radial margin around each air inlet is preferably about 2.5 mm to the inner diameter of the pump discharge gasket and 3.5 mm to the outside diameter. In the case that the vertical and horizontal alignment error of the axis of rotation 82 of the positioning arm 80 is 0, this translates to a stepping error of about 16 half-steps before the interface fails.

The stroke length or axial displacement of the pump 50 may be easily selected or adjusted to discharge a controlled volume of air to each of the printheads on the carriage. Design control of the length and cross-sectional area of each of the air passageways 100, 102, 104, 106 in the printhead holddown cover 38 to insure that the total volume of each passageway is substantially the same insures that, for a given pump stroke, the pump delivers the same volume and pressure of air to each printhead regardless of which printhead is being serviced. Each printhead may be primed utilising different priming parameters such as the pump stroke and duration as will be described in greater detail below, and these priming parameters for each printhead are stored in a software controller 300 of the printer for controlling the priming operation. The controller 300 is also connected to an environmental sensor 302 which measures the current ambient temperature and humidity surrounding the printer. These measurements may also be utilised by the controller 300 in determining the appropriate priming parameters for a particular printhead. The printer is able to identify specific printheads which are mounted in stalls within the printer carriage 30 in any manner known within the art, for example by reading a memory chip located on the printhead.

Figure 11:
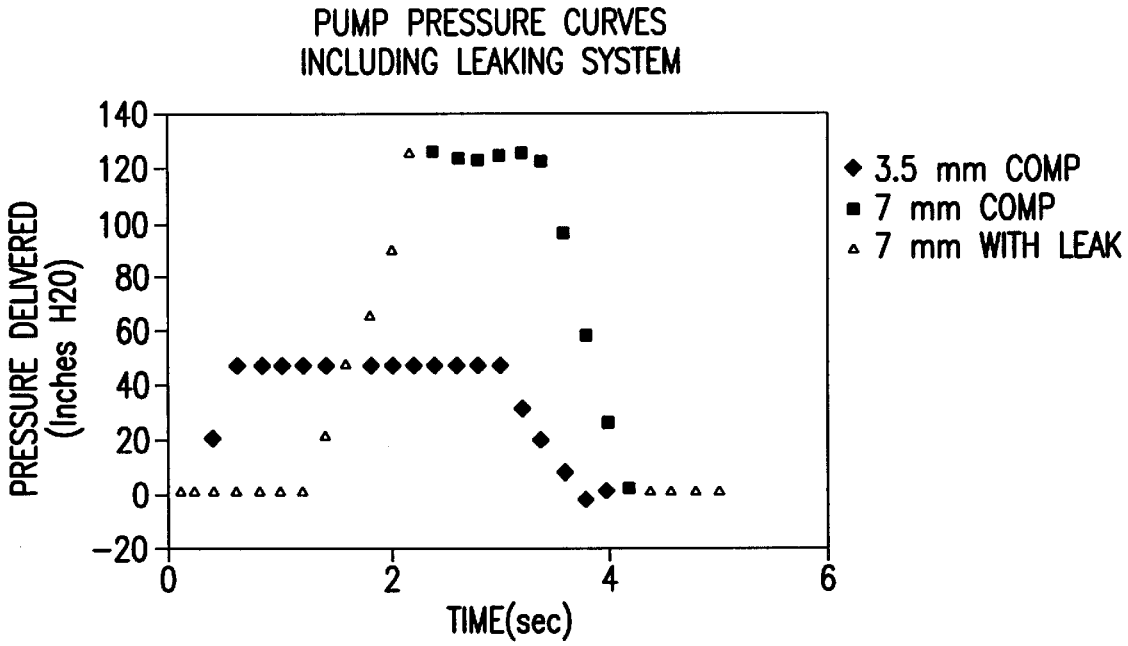
FIG. 11 is a graph plotting air pressure profiles delivered by the pump.

The pressure profile delivered by the pump is shown in FIG. 11 and is dependent upon the volume of the air passageways 102, 104, 106, 108 in the printhead holddown cover, the resting volume of the air chamber 69 in the pump itself and the rest position of the printhead carriage prior to priming. The curves shown in FIG. 11 are based upon an air passageway volume of 1.8 cc and a resting pump chamber volume of 3.2 cc. Three curves are shown. The 3.5 mm COMP curve shows the pressure profile at 3.5 mm axial displacement of the pump while the 7.0 mm COMP curve shows the pressure profile at 7.0 mm axial displacement of the pump. The third curve demonstrates the curve form when an air leak in the system is present. In this case, the priming pressure delivered to the printheads is slightly diminished but is still adequate to perform the priming function. The design of the pump 50 guarantees that the negative pressure caused when the pump displaced air is extracted (by movement of the printhead away from the pump) clips at a pressure of approximately −5.0 inches of water.

The precise location on the printer of the position of the compliant gasket at the pump outlet is determined by the use of a novel velocity servo bumping algorithm. The algorithm has general application to any two relatively moveable components but is more conveniently described in the context of an inkjet printer with reference to movement of the carriage 30 (a first component) with respect to the pump outlet 53 (a second component) to bump the components together preferably through a number of bumping cycles during which the current drawn by an electric motor used to move the carriage to cause the relative movement between the carriage and pump outlet is measured to establish a pulse width modification (PWM) threshold which is exceeded during the bumping. The deflection of one of the components (the pump outlet) has been characterized when the load power exceeds the threshold value.

Figure 13:
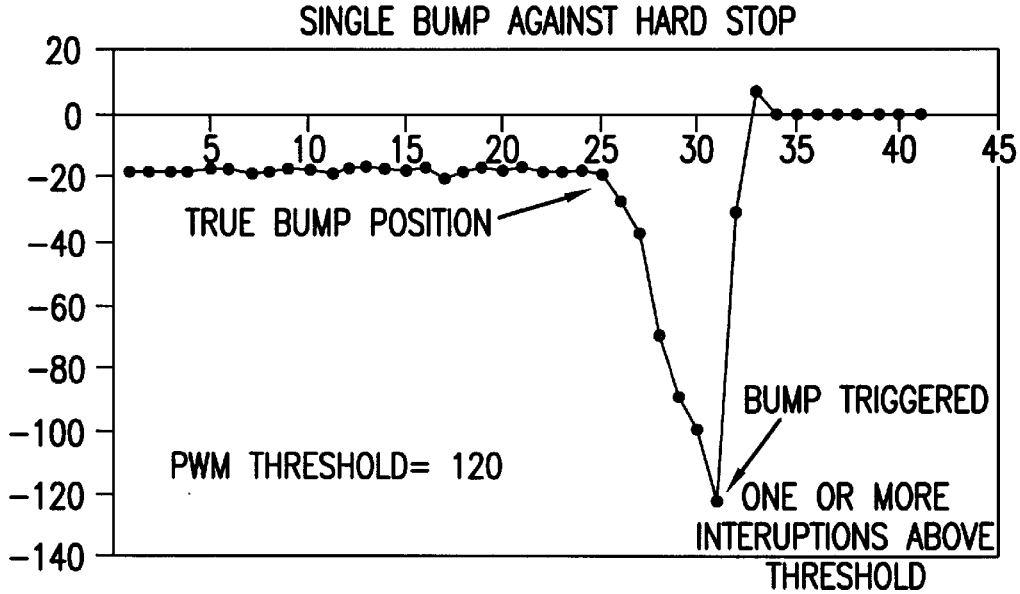
FIG. 13 is a graph of a velocity servo hard bump algorithm implementation.

Most bumping strategies require that the two contacting components have a minimum rigidity to function correctly. They typically assume that once the parts contact there will be no deformation or at least that the resulting deformation will be less than the precision required by the system. These algorithms, therefore, cannot be applied to systems having flexible components such as the compliant gasket 69 at the pump outlet 53. FIG. 13 shows a plot of carriage drive motor load (PWM) against interruptions in milliseconds for printhead carriage measurements for a hard bump environment.

To recognize the contact of a flexible component, the algorithm must react to single impulses in the PWM profile. This is to say that the servo algorithm must respond if the threshold is exceeded for a single processor interruption (1/1000 sec.). Also, the servo parameters must have a very undamped response to velocity error. The algorithm depends on the PWM instability at the point of contact to recognize the flexible component. Because the impact can be somewhat unstable and because there is additional noise in the system due to other sources, several bumping samples must be taken to insure data consistency. This data must pass the following sanity checks to be considered valid:

1. The average reading must not exceed a maximum variation from the nominal value (taken as 4σ of the distribution across many previous printers);
2. The 3σ value of the measurement distribution must not exceed a critical value for mechanism function (reading Cp): and
3. No single reading can vary from each machine's own distribution average by more than a critical value (erroneous data point).

Because of the delay of the servo and the compressibility of the flexible components, an offset should be calculated when determining the bump position.

Figure 12:
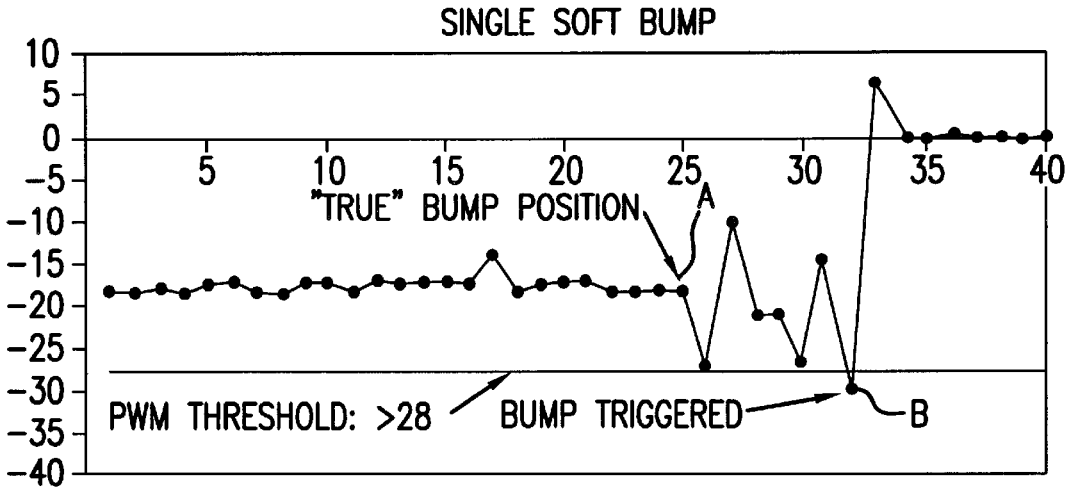
FIG. 12 is a graph of a velocity servo soft bump algorithm implementation.

As seen in the PWM evolution shown in FIG. 12 where the horizontal axis indicates interruptions in milliseconds, time B indicates when the PWM threshold (−28 as shown) was exceeded and time A indicates the point at which the true first contact occurred. The positional offset due to these effects has been characterized and shown to be repeatable. This occurs particularly in the case in which two flexible components are assembled in series (the gasket and the spring) with one of the two having a much higher stiffness and particularly preload.

FIG. 12 also demonstrates the transient noise which occurs due to both inertial and friction/stiction effects while accelerating the carriage and approaching the pump. To reduce the risk that the PWM threshold will be exceeded during this phase, carriage movement is started sufficiently far from the nominal position to ensure that discarding the first half of the PWM profile will both eliminate this noise and ensure the flexible component (the pump) is not touched during the initial movement.

The carriage is repeatedly positioned to deflect the pump outlet and during the bumping procedure. The currently preferred algorithm includes the following:

1. Number of bumping cycles: 12.
2. Offset due to connect gasket compression: 6 encoder units (0.25 mm).
3. Maximum variation of average reading from nominal: 24 encoder units (1.0 mm).
4. Maximum 3σ value: 12 encoder units.
5. Maximum single point deviation from average: 6 encoder units.

It has been found that the position of the pump outlet can vary by up to 1.0 mm during construction of a printer. Use of the above positioning algorithm reduces the error between actual pump outlet position and optimum pump outlet position to a maximum of 0.25 of this amount.

A preferred design of printhead for use with embodiments of the present invention and its operation during normal printing as opposed to during priming will now be described.

Figure 14:
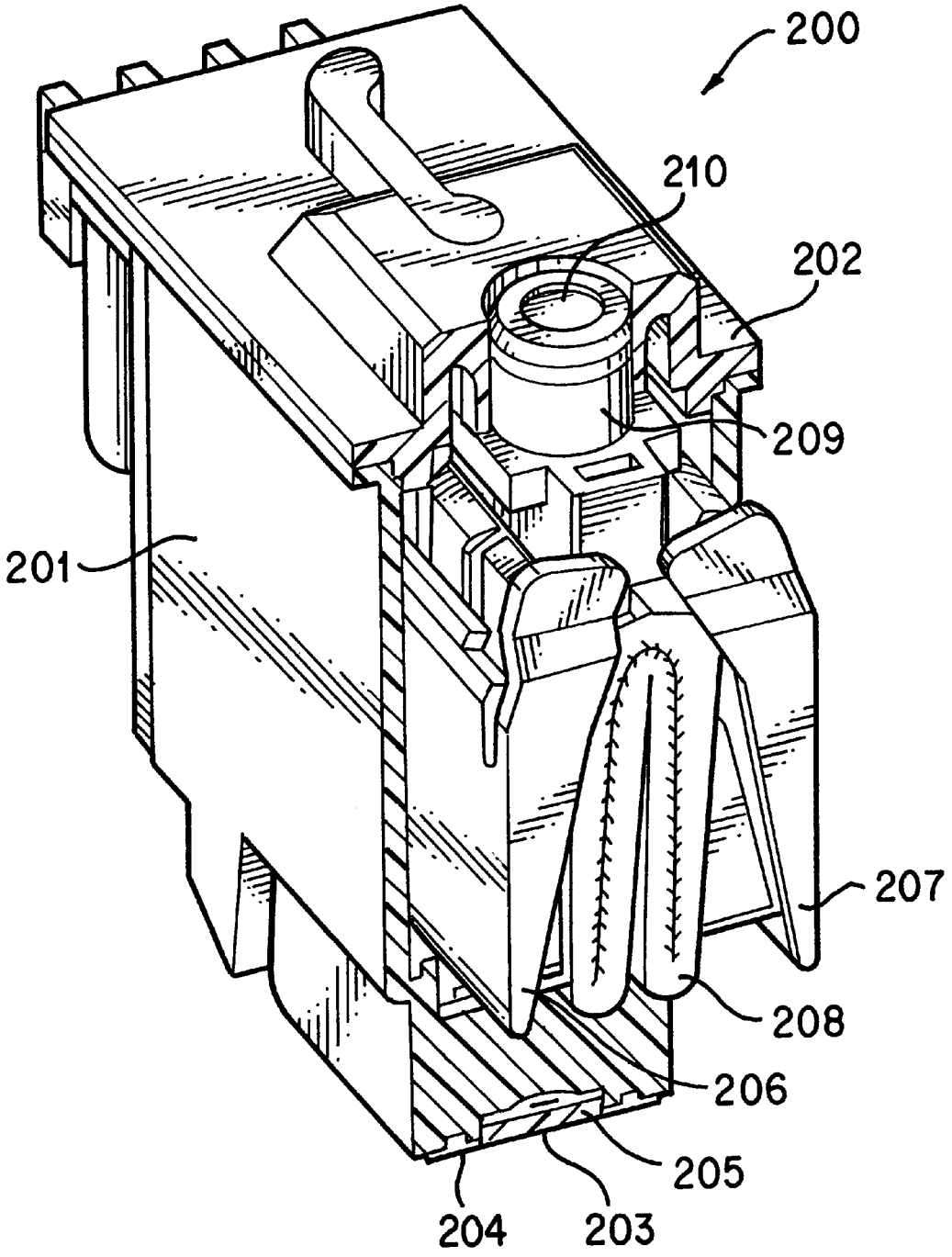
FIG. 14 is a perspective view in partial cross-section of a printhead showing a ink and pressure regulation mechanism.
Figure 31:
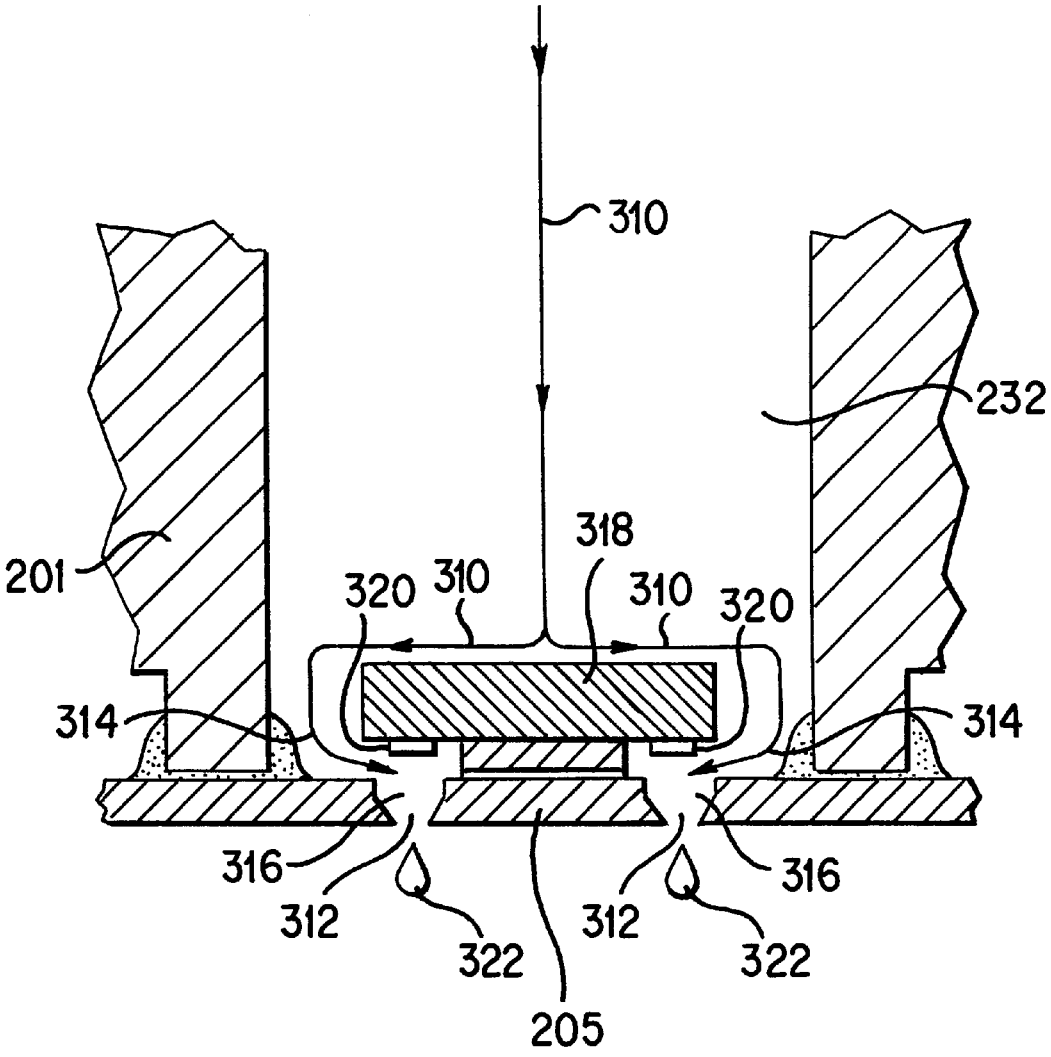
FIG. 31 is cross sectional enlarged view through the nozzle area of the printhead of FIG. 14.

Referring to FIG. 14, reference numeral 200 generally indicates the printhead that includes a body 201 and a crown 202 that forms a cap to the body and defines an ink chamber 232 with the printhead. Located at a remote end of the body is the tab head assembly 203 or THA. The THA includes a flex circuit 204 and a silicon die 205 that forms the nozzle plate. FIG. 31 is a cross-section through the THA showing the flow path 310 of ink from the ink chamber 232 of the printhead to the nozzle firing chambers 316 via narrow ink conduits 314. On the underside of substrate 318 are resistors 320 associated with each nozzle 312. In operation resistors 320 are energised to vaporise a small quantity of ink adjacent the resistor which causes the ink within the firing chambers 316 to be ejected through nozzles 312 as drops of ink 322. This ink ejection mechanism is of conventional construction. Also located within the pen body 201 is a regulator lever 206, an accumulator lever 207, and a flexible bag 208. In FIG. 14 the bag is illustrated fully inflated and for clarity is not shown in FIG. 15. The regulator lever 206 and the accumulator lever 207 are urged together by a spring 235, 235' illustrated in FIG. 15. In opposition to the spring the bag spreads the two levers apart as it inflates outward. The bag is staked to a fitment 209 that is press-fit into the crown 202. The fitment contains a vent 210 to ambient pressure in the shape of a helical, labyrinth path. The vent connects and is in gaseous communication with the inside of the bag so that the bag is maintained at a reference pressure during normal printing operations. The helical path limits the diffusion of water out of the bag and also serves to dampen the response rate of the levers 206, 207 to changes in the pressure differential between the ink chamber 232 and the ambient pressure.

Figure 15:
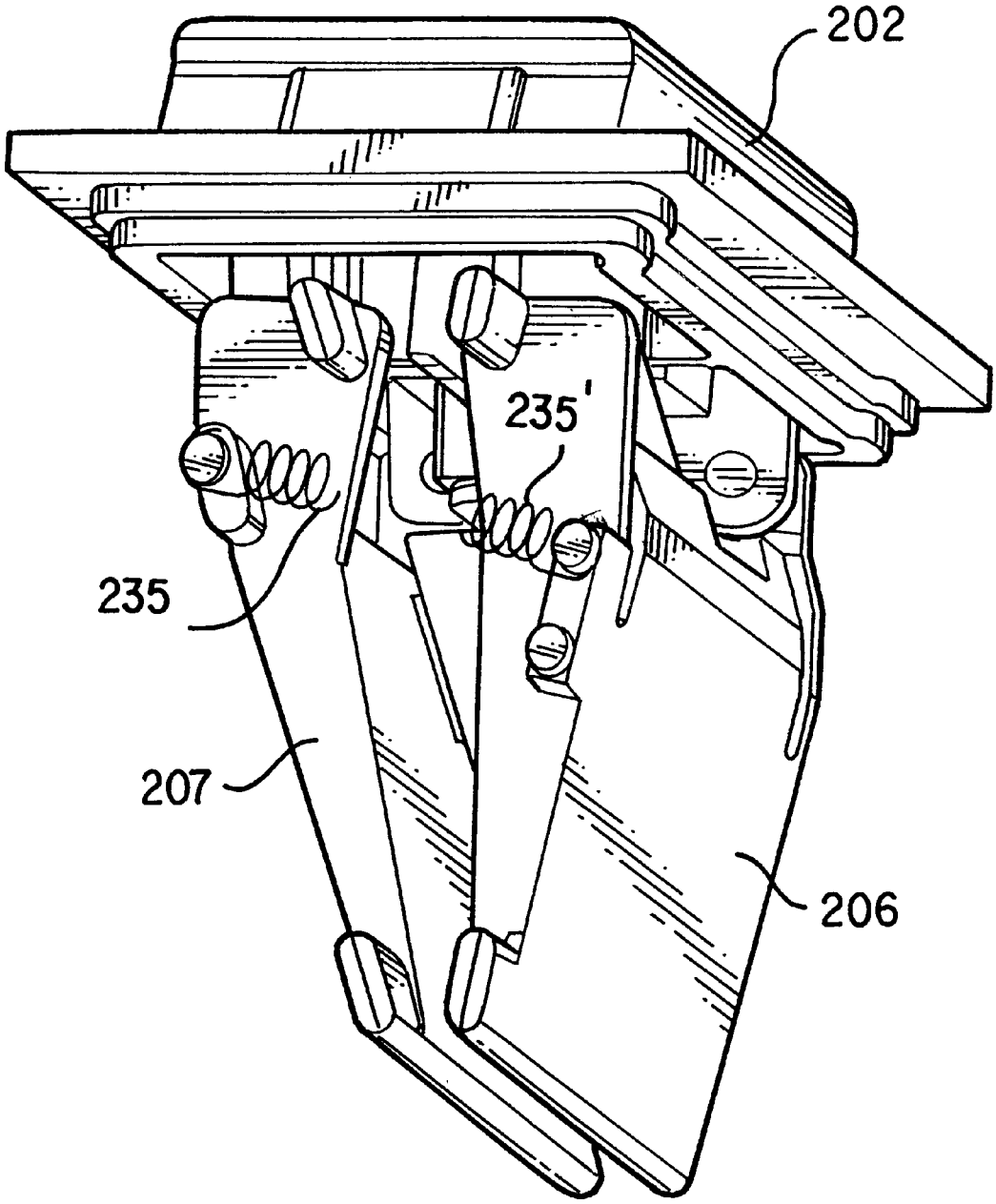
FIG. 15 is a perspective view of the regulation mechanism of FIG. 14 shown without the air bag.
Figure 16:
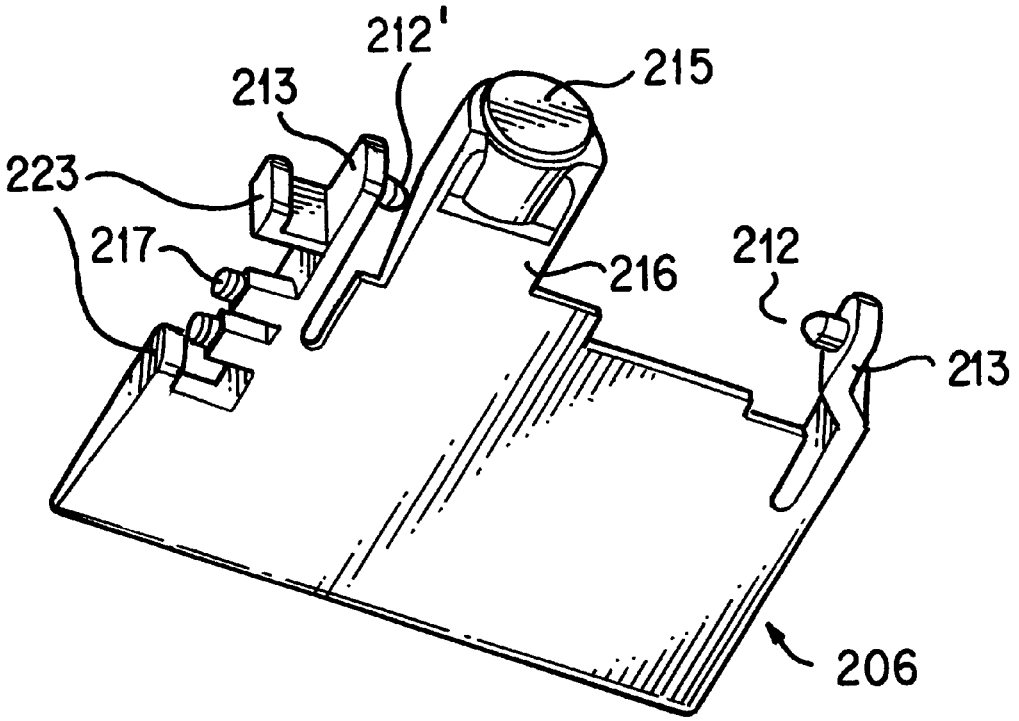
FIG. 16 is a perspective view showing a first side of a regulator lever of the regulation mechanism of FIG. 14.
Figure 17:
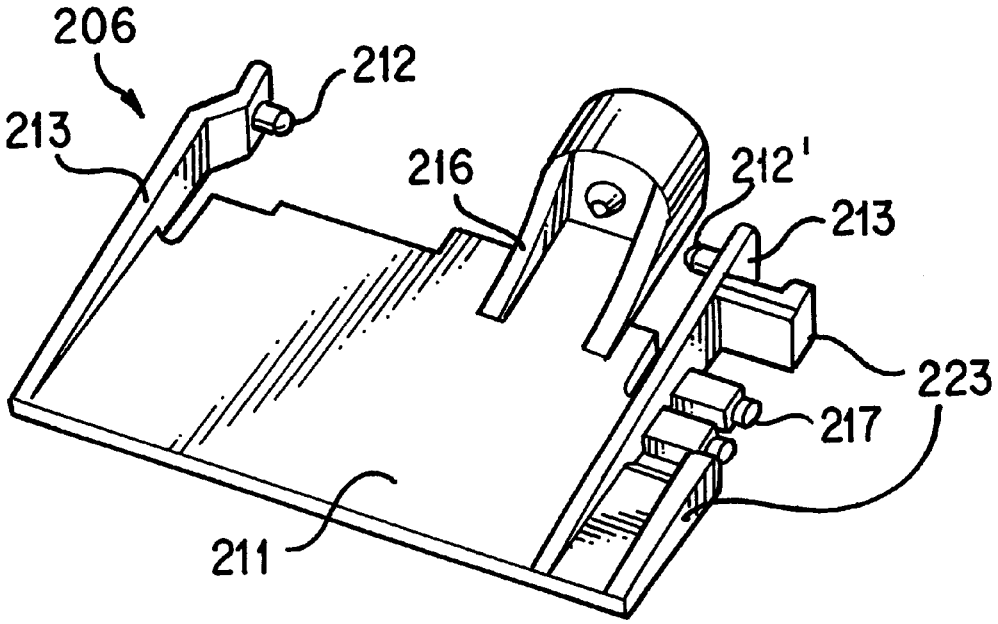
FIG. 17 is a perspective view showing a second side of a regulator lever of the regulation mechanism of FIG. 14.
Figure 18:
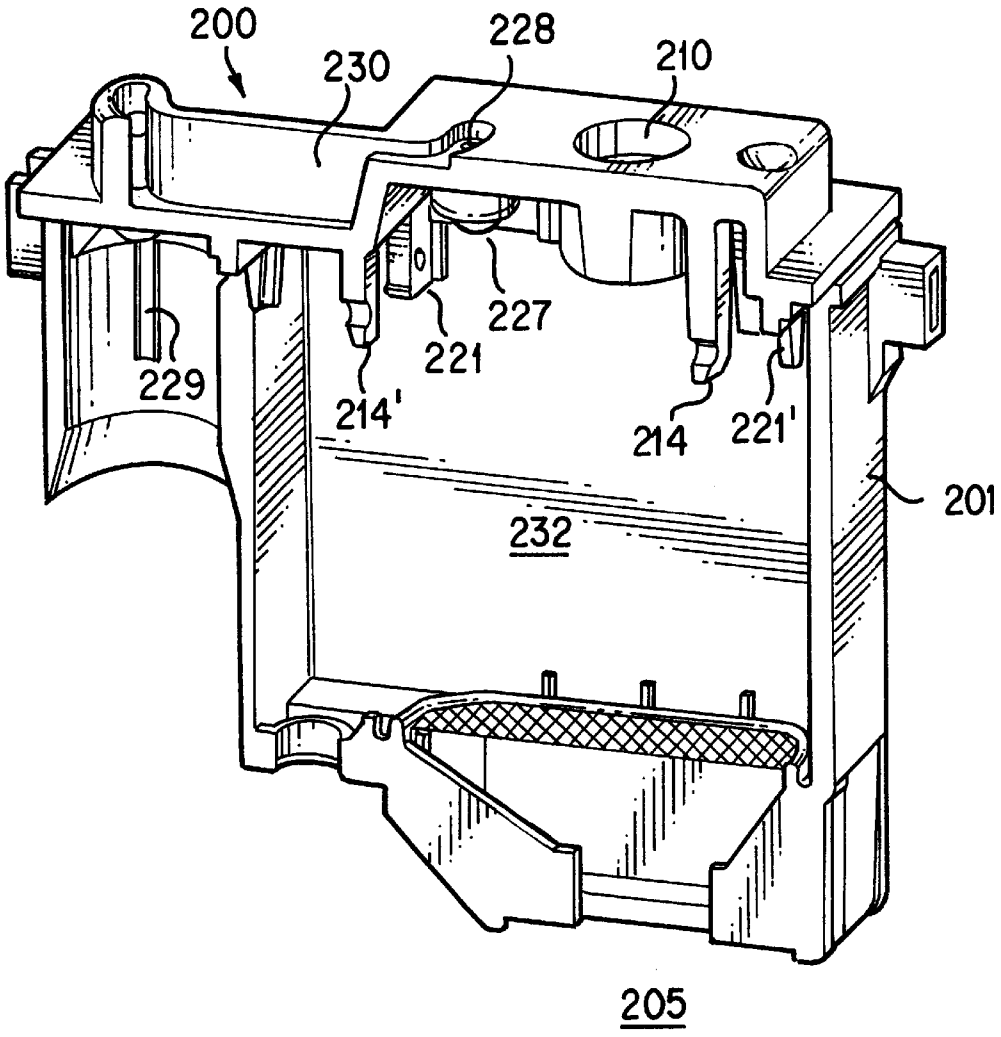
FIG. 18 is a cross-section through the printhead body.

The regulator lever 206 is illustrated in detail in FIGS. 16 and 17. Reference numeral 211 generally indicates the location of the area where the bag 208 directly bears against the lever. The lever 206 rotates about two opposed axles 212 that form the axis of rotation of the lever. The rotation of the lever is stopped when the lever engages the printhead body 201. The axles are located at the ends of cantilevers 213 formed by deep slots so that the cantilevers and the axles can be spread apart during manufacture and snapped onto place on the mounting arms 214 of the crown 202 as illustrated in FIG. 18. Perpendicular to the plane of the regulator lever 206 is a valve seat 215 and a valve seat holder 216. The valve seat is pressed into place on the holder and is fabricated from a resilient material. In response to expansion and contraction of the bag 208, the regulator lever 206 rotates about the axles 212, 212' and causes the valve seat to open and shut against a mating surface on the crown 202 as described below. This rotational motion controls the flow of ink into the printhead body. There is an optimization between maximizing the force of the valve seat and obtaining sufficient motion of the lever. In the embodiment actually constructed the lever ratio of the distance between the centroid of the lever, generally at point 211, and the axles 212 and the distance between the centre of the valve seat and the axles 212 is between two to one and five to one with four to one being preferred. The regulator also includes a spring boss 217 and engages the spring 235, FIG. 15. The spring boss is protected during manufacture by two shoulders 223 which are not illustrated in FIG. 15.

Figure 19:
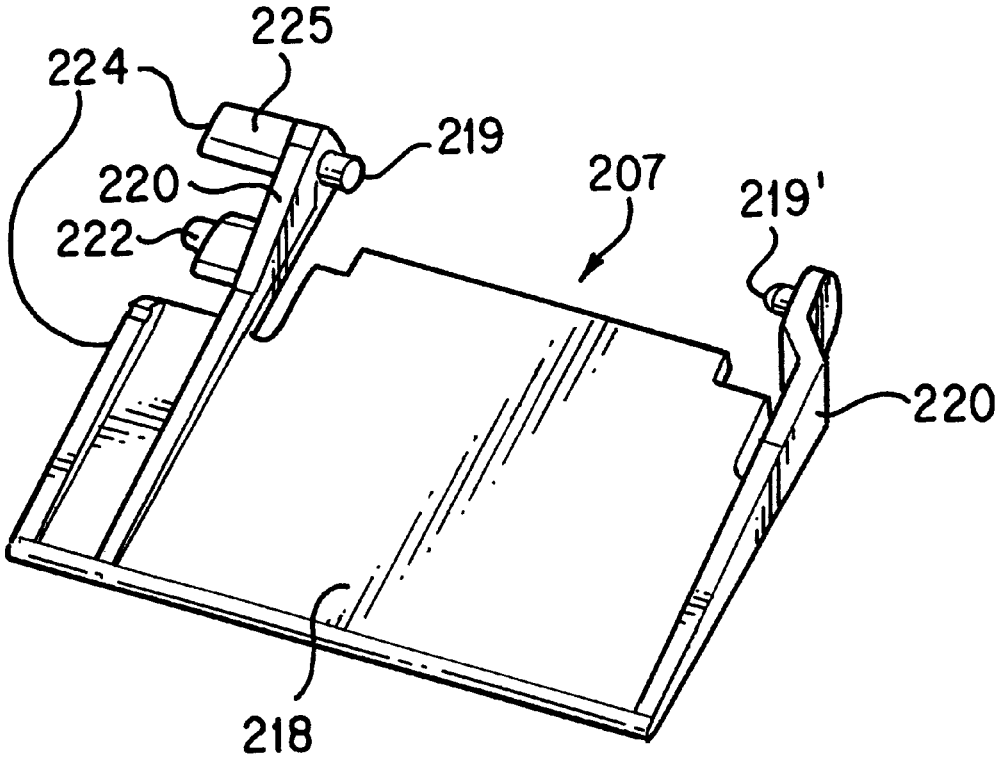
FIG. 19 is a perspective view of an accumulator lever of the regulation mechanism of FIG. 14.

The accumulator lever 207 is illustrated in FIG. 19 and includes an actuation area 218 where the bag 208 directly bears against the lever. The lever rotates about two opposed axles 219, 219' that form an axis of rotation of the accumulator lever. The axles are remotely located on cantilevers 220 so that the axles and the cantilevers can be spread apart during manufacture and snapped into place on the mounting arms 221, 221' of the crown 202 as shown in FIG. 18. The accumulator lever also includes a spring boss 222 that engages the other end of spring 235. FIG. 15 Like the spring boss 217 on the regulator, the boss 222 on the accumulator is protected during manufacture by the shoulders 224. These shoulders are not illustrated in FIG. 15.

Referring to FIG. 15 reference numerals 235 generally indicates a helical extension spring that urges the two levers 206, 207 together. The spring is preloaded and engages the bosses 217, 222 with a coil loop at each distal end. Each loop is a parallel cross-over, fully closed centred loop. This spring is designed to have the least amount of variation in its force constant over its full range of travel so that the back pressure can be regulated as closely as possible.

Figure 20:
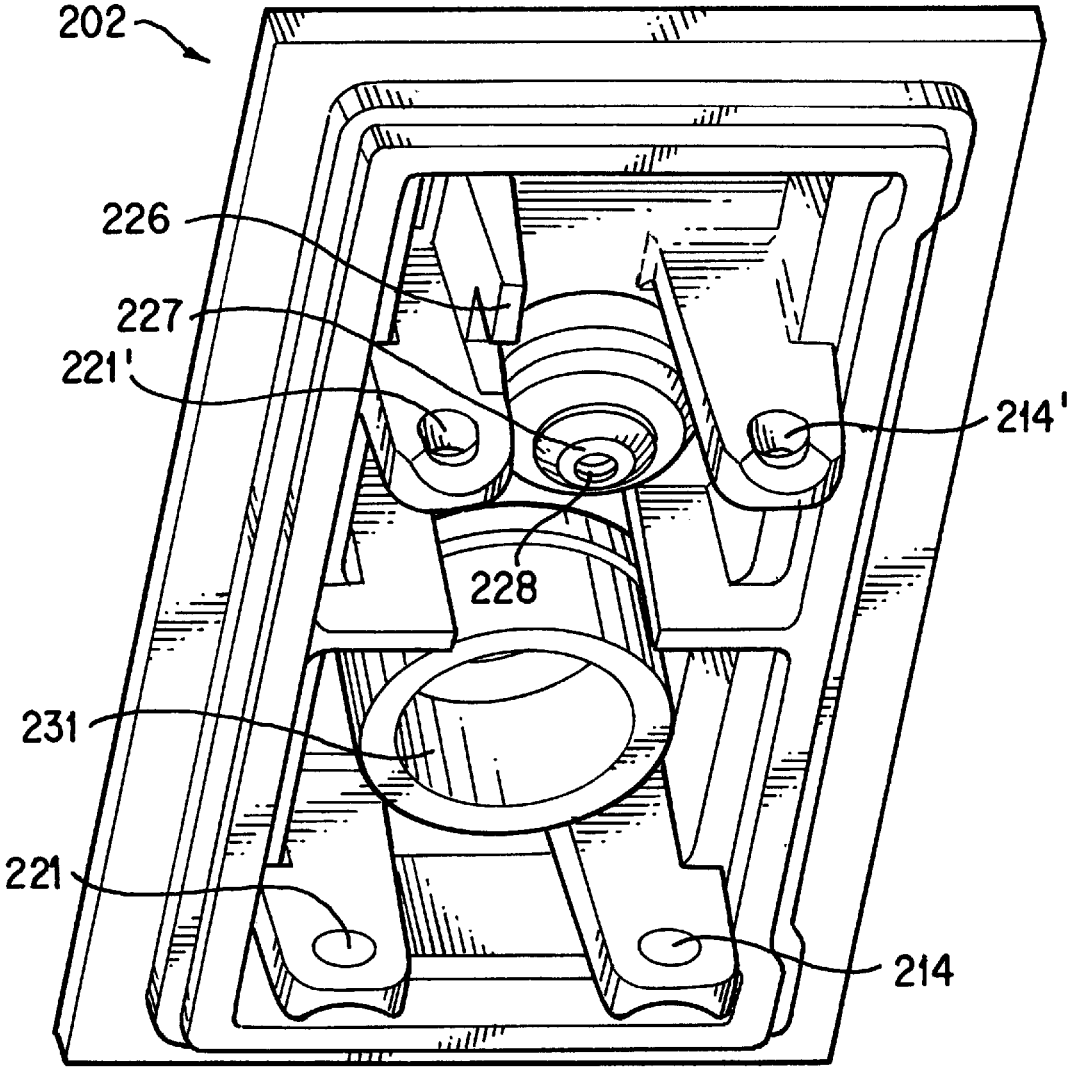
FIG. 20 is a perspective view from below of the crown of the printhead.

FIG. 20 illustrates the bottom side of the crown 202 which includes a valve face 227 and the orifice 228 through which ink enters the ink chamber 232. The valve face mates with the valve seat 215, FIG. 16 on the regulator lever 206. Ink flows through the fluid interconnect 229, FIG. 18, the ink channel 230 and the orifice 228. At orifice 228 the ink flow into the ink chamber 232 is controlled by the regulator lever 206. The bag 208 is attached to a boss 231 which provides a gaseous communication path between the interior of the bag and ambient pressure via the vent 210 of the printhead. The axles 212, 212° FIG. 17 on the regulator lever 206 are snapped into the journals 214, 214' as permitted by the cantilevered construction described above. In like manner the axles 219, 219' on the accumulator lever 207 are received in the journals 214, 214', FIG. 20. Also located bottom side of the crown is the surface 226 that engages the stop 225, FIG. 19 on the accumulator lever 207. The stop 225 and the surface 226 prevent the accumulator lever from interfering with the regulator lever 206.

During normal printing the flexible bag 208, shown in FIG. 14, expands and contracts as a function of the differential pressure between the back pressure in the ink chamber 232 and ambient pressure communicated through the vent 210. The bag is shown inflated in FIG. 14. The bag is designed to push against the two levers 206, 207 with maximum contact area through the entire range of travel of the levers.

The accumulator lever 207 and the bag 208 under normal printing conditions operate together to compensate for changes in the ambient atmospheric pressure and thus to maintain a substantially constant negative i.e. below atmospheric pressure within the ink chamber 232 (known as the back pressure). Also the accumulator and bag are able to some extent to accommodate changes in the volume of any air that may be entrapped in the printhead (known as warehoused air).

Although most of the accommodation is provided by the movement of the accumulator lever 207 and the bag 208, there is additional accommodation provided by the regulator lever 206 in cooperation with the resilient valve seat 215, FIG. 16. The valve seat acts as a spring and allows some movement of the regulator lever 206 in either direction while the valve is still shut (and thus preventing entry of ink into the printhead). In other words, as the back pressure in the ink chamber 232 decreases i.e. becomes less negative, the bag 208 exerts less force on the levers and the spring 235 urges the levers together. The motion of the regulator lever compresses the valve seat and the regulator lever shuts a little further. Alternatively, as the back pressure increases (becomes more negative) the bag 208 exerts more force on the levers and pushes them apart, however, due to the compliance of the value seat the regulator lever 206 is able to rotate a little before the valve opens.

It should be appreciated that the boss 222 on the accumulator lever 207 is closer to the axis of rotation of the accumulator lever than the boss 217. FIGS. 16 and 17, on the regulator lever is to its axis of rotation. This difference in distance is causes the accumulator lever to actuate before the regulator lever moves.

Figure 22:
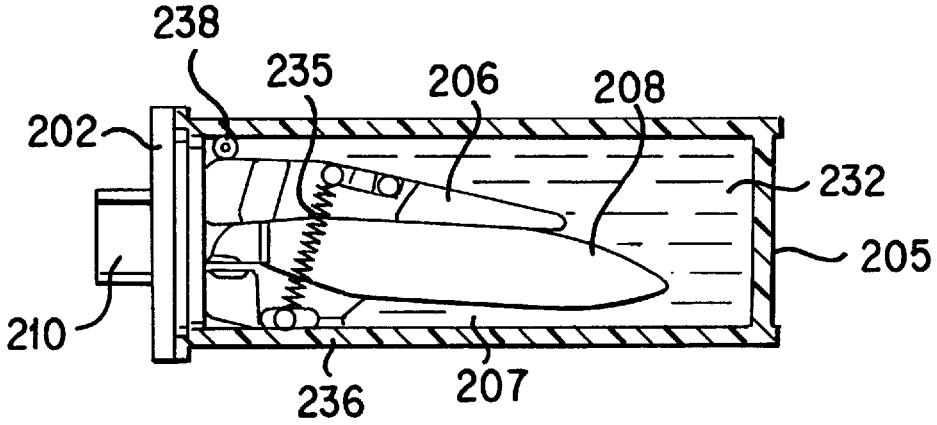
FIG. 22 is a schematic cross-sectional view of the printhead showing the regulator mechanism in a second partially open position.
Figure 23:
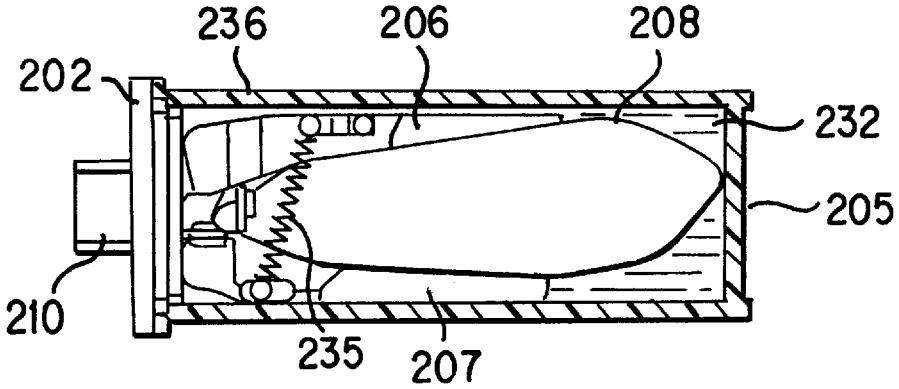
FIG. 23 is a schematic cross-sectional view of the printhead showing the regulator mechanism in a third fully open position.

The accumulator lever 207 rotates about the axles 219 until a stop 225 on the lever engages a surface 226 within the crown 202 as illustrated in FIGS. 20 and 19. The stop prevents the lever from moving too close and interfering with the regulator lever 206 when the back pressure in the ink chamber 232 drops. The accumulator lever rotates in the other direction until coming into contact with the printhead body 201 as illustrated in FIGS. 22 and 23.

Figure 21:
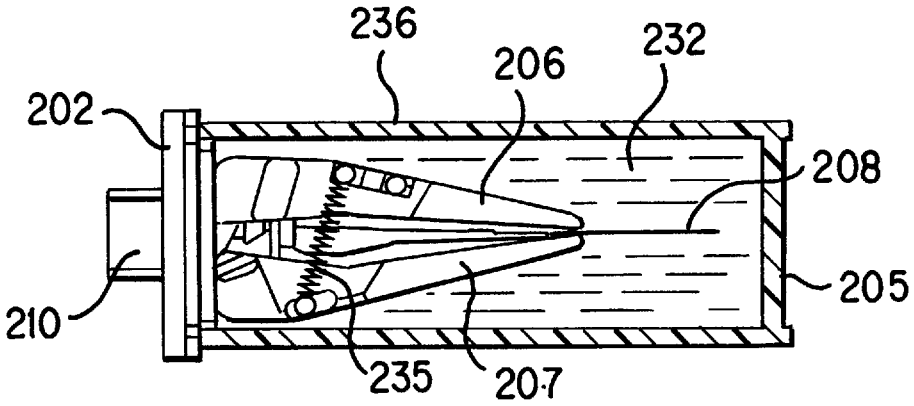
FIG. 21 is a schematic cross-sectional view of the printhead showing the regulator mechanism in a first fully closed position.

When mounted within a stall of the carriage 30 of the printer as shown in FIG. 1, the vent 210 of the printhead is connected to ambient atmospheric pressure via one of the air conduits 100, 102, 104 or 106 in the printhead holddown cover 36. The fluid interconnect 229 of the printhead is connected by means of one of the flexible supply tubes 50, 51, 54 or 56 to one of four removable ink reservoirs 20, 22, 24, 26 located on the left hand side of the printer as seen in FIG. 1. Each ink reservoir is individually pressurised under control of the printer to deliver ink to In normal printing operations the accumulator and regulator levers 207, 206 move within the printhead body 201 as shown in FIGS. 21, 22 and 23 dependent on the ambient atmospheric pressure and the speed of printing and thus of supply of ink to the printhead. In FIG. 21 the two levers are shown fully together, the flexible bag 208 is limp and empty of air—this may be due to a large drop in the ambient atmospheric pressure for example or is the condition of the printhead prior to initial filling with ink. If the atmospheric pressure increases, or the pressure within the ink chamber 232 decreases, for example due to ink being ejected from the printhead during printing, the flexible bag 208 fills with air drawn through the air conduit in the carriage cover via the vent 210 of the printhead. Expansion of the bag 208 causes rotation of the accumulator lever 207, against the operation of the spring 235 thus maintaining a substantially constant pressure differential (set essentially by the choice of spring 235) between ambient pressure and the pressure within the ink chamber 232 so as to promote effective operation of the printhead. The accumulator lever 207 is able to rotate until it comes into contact with the inner wall 236 of the printhead body 201 as shown in FIG. 22 and it should be noted that it is only at this point, due to the differences in lever arm distances, that the regulator lever 206 begins to rotate. The regulator lever 206 is able to rotate some small amount prior to the opening of the ink orifice 228, due to the resilience of the valve seat 215, whereupon ink flows into the ink chamber 232 from the remote in reservoir under pressure. The regulator lever 206 is able to rotate until it meets the opposite inner wall 236 of the printhead body 201 and is shown in this fully open position in FIG. 23. Once the pressure differential between the ink chamber 232 and atmosphere has been reestablished the regulator lever 206 rotates back to close the ink valve 227.

Occasionally normal printing operation is suspended in order for one or more printheads to be serviced by the printer for example by performing spitting, priming and/or wiping operations. This many be initiated by the printer at regular intervals, only when a problem with a printhead is detected by the printer or as a result of a user request following detection by the user of a printing problem or by any combination of these circumstances.

In order to prime a printhead mounted within the printer carriage by the use of a carriage activated air pump 50, the alignment processes described above are first carried out and the piston 52 of the pump is aligned to the air conduit connected to the vent 210 of the printhead. Then a precise movement of the carriage 30 is implemented by the printer to cause the pump 50 to deliver a predetermined volume of air to the flexible bag 208 within the printhead under pressure. This causes the bag to expand within the printhead body 201 and thus to increase the pressure within the ink chamber 232 causing a priming flow of ink into the nozzles 205. When the carriage 30 is moved away from the pump 50 the pressure within the bag 208 returns to atmospheric and the bag in cooperation with the accumulator and regulator levers 207, 206 acts to reestablish the desired pressure differential between the ink chamber and ambient pressure as described above.

The priming operation may be performed with a volume of air delivery to the bag 208 of the printhead which is sufficient to cause movement of the accumulator lever 207 of the printhead but not cause any or insufficient movement of the regulator lever 206 so that the ink valve orifice 228 is not opened and the ink chamber 232 is not exposed to the pressure of the ink supply from the reservoirs 20,22,24,26. However, it has been found for particular printhead designs and for particular ink types that it is advantageous to deliver a further controlled volume of air during priming so that the bag 208 expands to further increase the pressure within the ink chamber 232 and thus causes the regulator lever 206 to be rotated. It is important in these cases to control the supply pressure of ink from the remote reservoirs so as to prevent a large flow of ink into the printhead. Thus preferably a first step in the priming process is to set the pressure of the ink supply from the remote reservoirs to a level at which an insubstantial amount of ink will flow either into or out from the printhead once the ink valve 228, 227 is opened. This ensures that any flow of ink to or through the nozzles of the printhead is controlled by the air priming system which can be precisely controlled by the printer since it is actuated by carriage movements and not by the ink supply pressure. In the present embodiment the ink supply pressure is first reduced to zero from the pressure used during normal printing and is then raised to the lower pressure used for priming.

It has also been found that a precisely controlled purge of ink through the nozzles of the printhead to form a puddle of ink on the outside of the nozzle plate which is then drawn back into the printhead is effective in resolving a number of problems with printheads which are difficult to resolve without such flowback of ink. For example, the following problems may be alleviated by this technique:

1) dried ink tends to build up on the nozzles plate of printheads after extended use and may interfere with the correct ejection of ink drops for example causing misdirection of the ink drops. The ink itself is the optimal solvent for dried ink and the formation and maintenance of a puddle of ink around such accumulated dried ink allows the dried ink to dissolve or be removed from the nozzle plate.
2) air bubbles may become trapped within the nozzles or the narrow ink conduits leading to the nozzles. The outward flow and then subsequent backward flow of ink through the nozzles tends to break such bubbles free so that they are able to move either out of the printhead or to an innocuous location inside the ink chamber of the printhead as shown in FIG. 22, as so called warehoused air, 238.
3) particles which may become trapped within the printhead during manufacture or which may be brought into the printhead by ink can clog or partially block the flow of ink to a nozzle. If this occurs the nozzle may fire ink at faster rate that it can be replaced which can cause the nozzle to gulp air from outside the nozzle. While generating an ink puddle, ink flows out of nozzles adjacent the blocked nozzle and as the puddle is drawn back into the printhead, flow may also occur through the blocked nozzle causing the particle to move from the nozzle to a more innocuous position within the printhead.
4) for a nozzle to function correctly a constant supply of ink is required so that ink fired from the nozzle is replaced by ink from the ink chamber flowing along the ink conduits. If this continuous ink line is broken to a few nozzles which are then starved of ink this is called a local deprime. If this occurs across all nozzles on a nozzle column (shown in FIG. 3) it is called a global deprime. The controlled flow of ink firstly out through the nozzles and then back into the nozzles is effective in providing ink to these dry ink conduits and nozzles.

The volume of air delivered by the pump 50 to the printhead bag 208 is controlled to achieve a desired increase in pressure within the ink chamber 232 of the printhead which is sufficient to cause the formation of a puddle of ink of a predetermined volume on the nozzle plate as will be described in greater detail below. As the carriage 30 moves away from the pump 50 air is withdrawn from the bag 208, thus generating a negative pressure within the ink chamber 232 and facilitating the required flowback of ink into the printhead through the nozzles. This flowback is further facilitated by the spring 235 of the printhead which acts to compress the bag 208 forcing air out of the vent 210 and reestablishing the desired negative pressure within the ink chamber 232.

While it is conceivable that the application of a controlled negative pressure to the outside of the nozzle plate of a printhead could be utilised to generate a puddle of ink on the nozzle plate, prior art negative pressure priming systems apply a relatively high vacuum for a relatively short period of time and are thus generally unsuitable. Such high rates of ink extraction generally cause the extracted ink to foam, i.e. the formation of tiny bubbles within the ink, and if such extracted ink is then allowed to reenter the printhead via the nozzles these air bubbles could easily become trapped in the nozzles or ink conduits leading to the nozzles.

The presently described technique for purging small quantities of ink onto the nozzle plate of a printhead in the form of a puddle which is largely recaptured by the printhead should be distinguished from prior art techniques in which large volumes of ink are passed through a printhead in order to remove large volumes of warehoused air.

A further technique which has been found to be effective for alleviating problems with printheads when applied either additionally or alternatively to the techniques described above, comprises the firing, or spiting of ink drops into an ink puddle formed on the nozzle plate of a printhead. Preferably this technique is applied in addition to the positive pressure priming technique described since this is convenient for the generation of a controlled puddle on a nozzle plate. It has been discovered that if nozzles of an inkjet printer are fired into a puddle which is maintained on the nozzle plate of the printhead so as to cover the nozzles the ink ejected is trapped by the puddle. Since the drops do not escape the puddle they create a turbulence within the ink of the puddle around the firing nozzles, which it has been found is effective in recovering the correct operation of defective nozzles. Although the word "drops" has been used to describe the action of firing nozzles into a puddle of ink, it will be appreciated that (since the outside of the nozzle is covered by ink which should be in fluid contact with the ink within the firing chamber) when the nozzle is fired the ink ejected does not normally contact air and thus does not have an ink to air surface. These "drops" can thus be seen to more accurately be described as a flow or jet of ink ejected into a larger reservoir of ink within the puddle.

Figure 24:
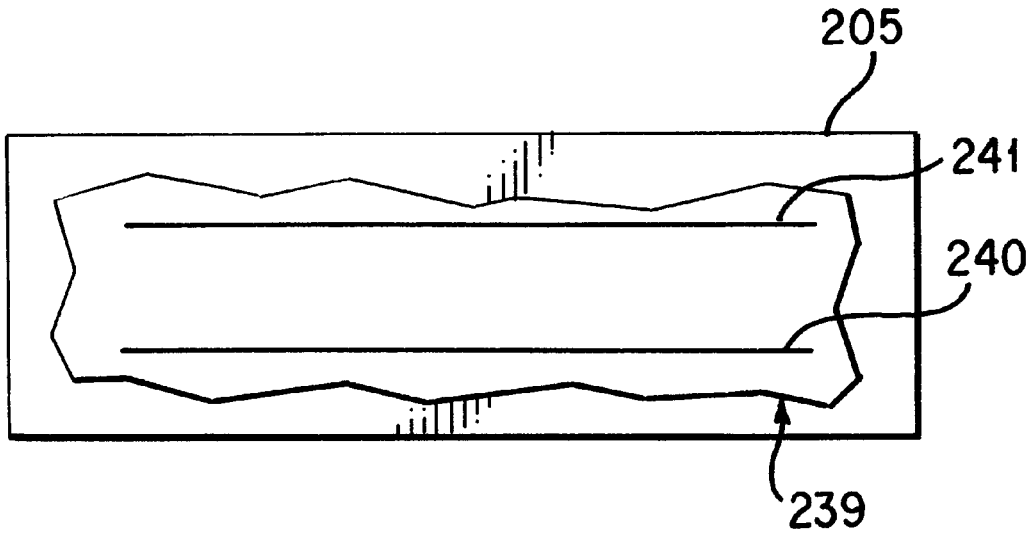
FIG. 24 is a schematic drawing of the nozzle plate of a printhead from below showing a puddle of ink covering both columns of nozzles.
Figure 25:
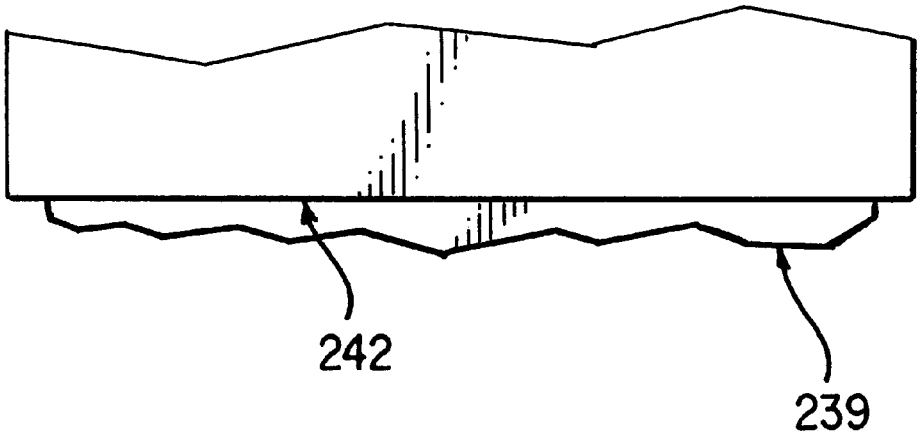
FIG. 25 is a side elevation of the schematic drawing of the nozzle plate of FIG. 24 showing schematically the firing of ink drops into a puddle of ink.

As shown in the schematic diagram of FIG. 24, the puddle 239 formed on the nozzle plate 205 should extend to cover substantially all of the nozzles of the nozzle plate (shown in two nozzle columns 240, 241). FIG. 25 schematically shows the drops 242 being fired into the puddle 239 and being captured by it. While it is preferred that substantially all the nozzles are covered by the puddle during this process, it has been found particularly for lower viscosity inks, that if the nozzles plate is not held substantially horizontal within the printer carriage the puddle may move to one side of the nozzle plate exposing some of the nozzles to air.

Figure 26:
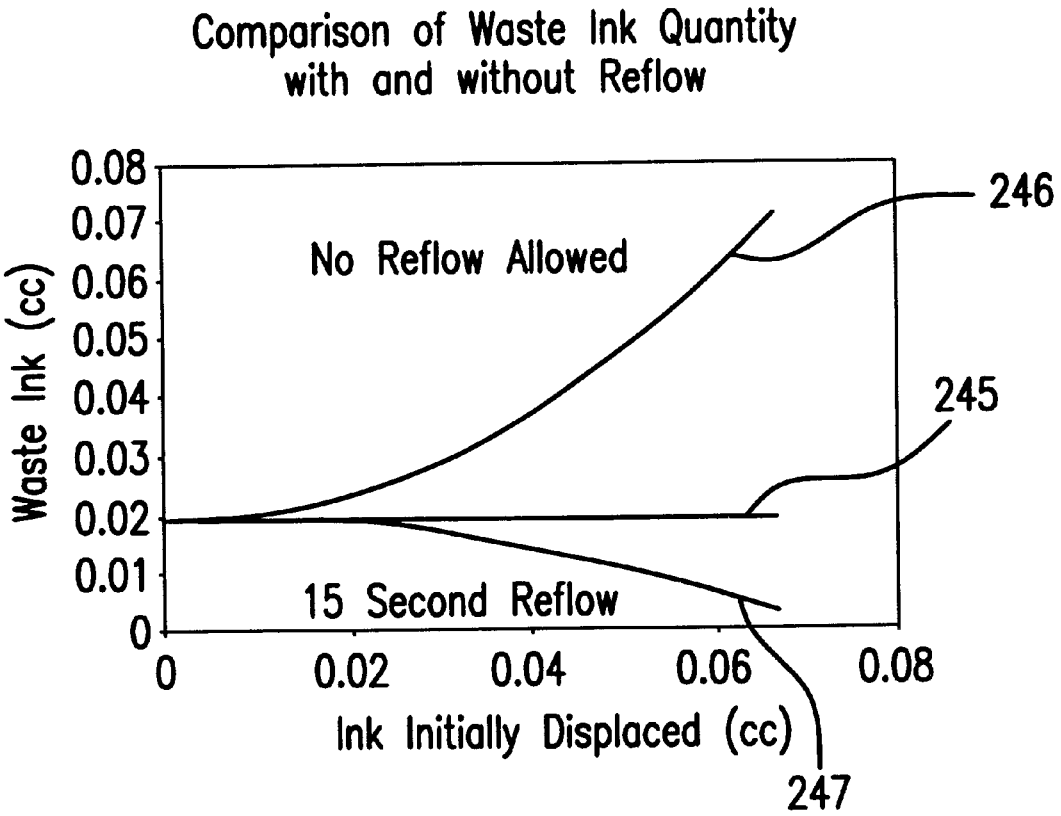
FIG. 26 is a graph of the volume of waste ink when servicing a printhead for the case of spitting only, spitting while priming with no flowback of ink and spitting while priming with flowback of ink into the printhead.

In addition to being a convenient method of generating a controlled puddle of ink, the use of a positive pressure within the printhead ink chamber 232 has been found to increase the volume of the drops fired which increases the effectiveness of this technique in recovering non-functional nozzles. Furthermore when this technique is employed in combination with the flowback of the puddle ink into the printhead the volume of ink lost from the printhead compared to prior art spitting or prior art priming techniques is dramatically reduced. FIG. 26 is a graph showing the volume of ink waste from a recovery operation on a printhead which employs a positive pressure prime technique as described above to generate a puddle of ink and spits ink drops into the puddle. The horizontal curve 245 represents the volume of ink that would be lost due to spitting alone as per prior art recovery techniques. This volume is simply the volume of the drops fired over a given time period and thus remains constant as a function of ink displaced by the priming operation which is plotted on the x-axis of the graph. Here the firing of 512 nozzles 1000 times results in a waste ink volume of approximately 0.019 cc. The upper curve 246 represents the volume of ink that would be lost if none of the ink from the priming process nor from the spiting process were drawn back into the printhead. The lower curve 247 shows the actual ink lost when spitting and priming are performed together so that the controlled puddle formed captures fired drops and the puddle is sucked back into the printhead by for 15 seconds. As can be seen from FIG. 26 the amount of waste ink is reduced as the ink initially displaced by the priming system increases. This is because as the puddle created by the priming process increases in size so does its ability to trap drops fired and the effectiveness of the flowback into the printhead. This trend is halted when the puddle formed is so large that surface tension forces no longer hold it to the nozzle plate and a very large drop of ink detaches from the puddle and drops into the spittoon of the printer.

The reduction of the quantity of waste ink has a number of advantages. Firstly, it allows more of the available ink to be utilised for printing, secondly it reduces the build up of ink on components of the printer (some of which may be handled by user) for example service station components and thirdly it extends the lifetime of the printers spittoon. A further advantage of spitting into an ink puddle compared to conventional spitting into a spittoon is that aerosol (tiny air borne ink particles generated whenever a nozzle is fired) is substantially reduced since this is also trapped by the puddle.

The firing of ink into the puddle of ink has additionally been found to be very effective in aiding the recovery of the printhead from any small air bubbles which may be trapped within the nozzles or ink conduits. This is believed to be because the drops fired dislodge such contaminants.

While normally all the nozzles of a printhead are fired during the above described spitting while priming process it has been found that in some circumstances it is advantageous to fire only some of the nozzles. It is know in the art to detect by various means the functional and the non-functional nozzles within a printhead. For example by means of a drop detector which is able to detect drops of ink fired from a nozzle as they cross a light beam within the service station of the printer. Alternatively, a test pattern may be printed by the printer in which blocks are printed by ink ejected from a single nozzle. This test pattern may then be scanned either by the printer operator who manually inputs the results to the printer or automatically by a sensor mounted on the printer carriage (as described in EP 0863012 in the name of the present applicant, which is hereby incorporated by reference). In such a manner the printer may determine which of the nozzles of a particular printhead are correctly ejecting ink and which are not.

It is thus preferred that the present printer comprises such a system and that subsequent to determining which nozzles are correctly functioning, only these nozzles are actuated by their associated resistors and firing chambers during the described spitting into an ink puddle process. This is advantageous because, as described above the attempted firing of nozzles the ink conduits of which are blocked or partly blocked by a particle may cause the nozzle to gulp air thus exacerbating problems with the printhead. Firing only working nozzles, which are covered by the ink puddle, around the blocked nozzle and then drawing ink back into the printhead from the ink puddle through the blocked nozzle is an effective technique for clearing particles from the nozzle or its associated ink conduit.

Alternatively, only the nozzles which are not functioning correctly may be fired during the recovery process. This can be effective for example when a nozzle is blocked by a dried plug of ink.

The firing of only some of the nozzles of the printhead during the above described recovery processes also serves to reduce the wear caused by repeated firing of nozzles and reduces the amount of waste ink.

It has been found that the effectiveness with which nozzle malfunctions can be corrected is improved by the repeated firing of nozzles, but that the firing frequency should be lower than that normally used when performing printing operations with the printhead. It is believed that this may be because firing of the nozzles at these lower repetition rates increases the volume of the drops fired and thus increases the flow of ink through the nozzles. Furthermore, lower firing frequencies facilitate the movement of air bubbles from the nozzles and their associated ink conduits which may not be able to move, and may even increase in size, if exposed to very high firing frequencies.

It will be appreciated that the techniques described above for priming and recovering the correct operation of printheads may be applied to many differing designs of printheads and that the parameters necessary for the effective use of these techniques will depend on the design of such printheads and on the characteristics of the ink used with the printheads. As will be apparent to those skilled in the art, a number of tests should be carried out on each design of printhead and ink to be utilised in order to determine such parameters and some of these tests will now be described together with parameters that have been found to be effective when utilised with ambient air regulator printheads designed and sold by Hewlett-Packard so as to provide a further guide to the implementation of, and understanding of, embodiments of the invention.

Figure 27:
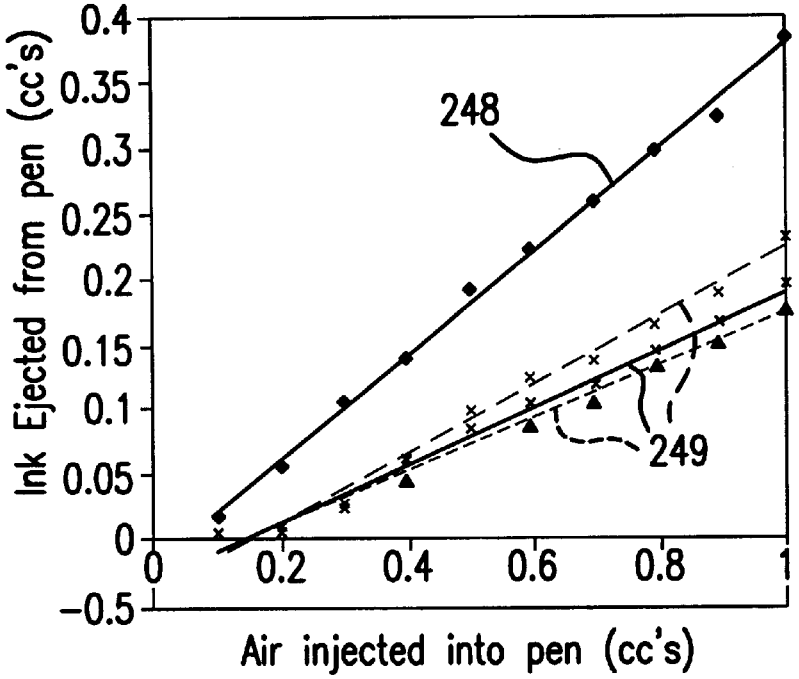
FIG. 27 is a graph of the volume of ink purged onto the nozzle plate of a printhead during priming as a function of the volume of air injected into the printhead during priming for black and colored ink printheads.

FIG. 27 is a graph of the volume of ink ejected or purged (during a priming operation having a duration of one second) onto the nozzle plate 205 of a number of different printheads having black, yellow, cyan and magenta ink as a function of the volume of air injected into the air chamber 208 of the printhead from the pump 50. As can be seen this relationship is well defined and thus a specific predetermined volume of ink can be placed on the nozzle plate of a printhead by appropriately controlling the pump 50. The particular pump employed (and described above) delivers 0.2 cc of air for each millimeter of movement of its piston 52 and since it is actuated by movement of the printer carriage 30, which necessarily is capable of extremely accurate movement (typically three hundredths of an inch) in its main function of positioning the printheads for printing, the delivery of air can be accurately controlled. It will be noted that the curve 248 for the black printhead is substantially different from those for the colored inks 249. This is due partly to a different design of the black printhead and partly due to the different nature, particularly viscosity of the inks. The black utilised for this particular design of printhead employs a pigmented ink which has a higher viscosity than that of the dye inks employed in the cyan, magenta and yellow printheads. Due to this higher viscosity as well as different ink formulation and different printing requirements for the black printhead, the internal architecture of the black printhead is different and in particular has larger diameter ink conduits leading to the nozzles, this architecture (despite the higher viscosity of the ink) has resulted in the steeper curve 248 shown in FIG. 27.

Figure 28:
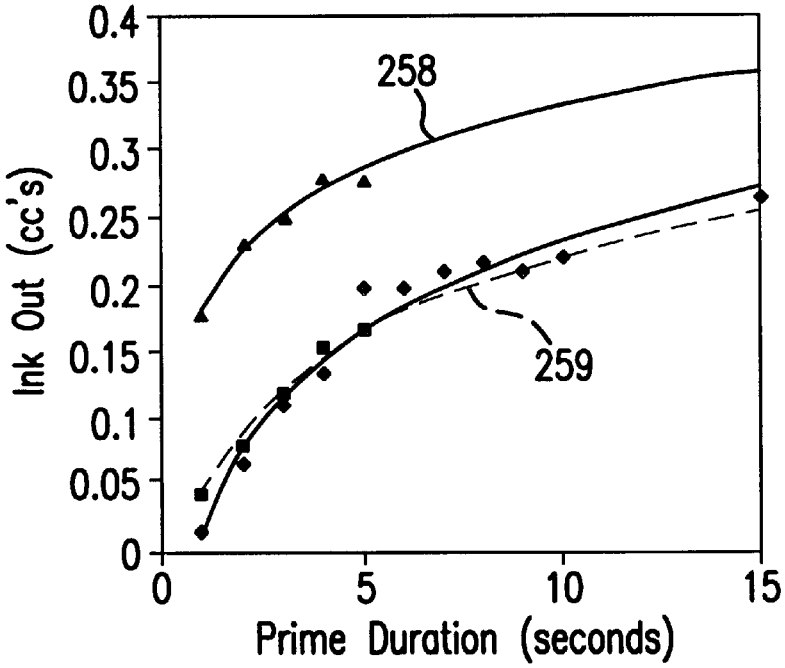
FIG. 28 is a graph of the volume of ink purged onto the nozzle plate of a printhead during priming as a function of the duration of the priming operation for black and colored ink printheads.

A further important parameter for priming is the duration for which the positive pressure within the air chamber 208 of the printhead is held. FIG. 28 is a graph of the volume of ink purged onto the nozzle plate of various printheads against the prime duration for a primed air volume of 0.4 cc and with the printhead isolated from the remote ink supply reservoir. As can be seen the volume of purged ink increases steeply with time at first and then more slowly. Also the curve 258 for the black printhead is again offset from the curves 259 for the colored ones.

Figure 29:
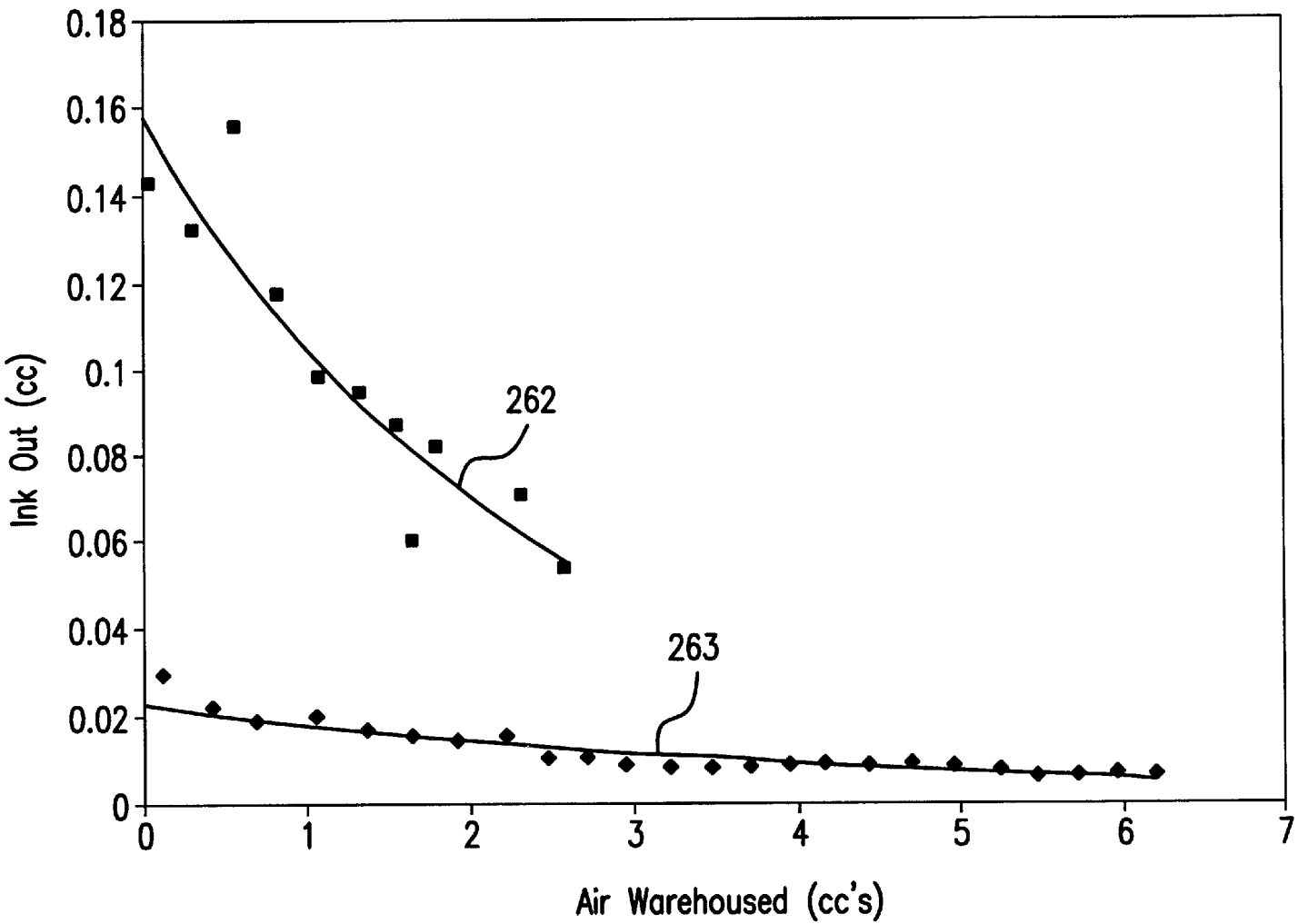
FIG. 29 is a graph of the volume of ink purged onto the nozzle plate of a printhead during priming as a function of the volume of air warehoused within the ink chamber of the printhead for black and cyan ink printheads.

It is a known problem, particularly for longer life printheads, that air 238 may accumulate in the ink chamber as shown in FIG. 22. This warehoused air is a compressible component within the ink chamber 232 of the printhead and thus affects the efficiency with which the air delivered to the air chamber 208 by the pump 50 can increase the pressure within the ink chamber and thus purge ink onto the nozzle plate. FIG. 29 shows how the volume of ink purged decreases as the volume of warehoused air increases for a black 262 and a cyan 263 printhead. The priming parameters for each printhead are calculated taking into account the average volume of air the printhead is likely to have to warehouse during its life so that a new printhead when primed purges slightly more than the ideal volume of ink and a printhead at the end of its life purges slightly less than the ideal volume of ink. An alternative is to store several priming parameters for each printhead and to change the parameters utilised dependent on the life of the printhead.

Figure 30:
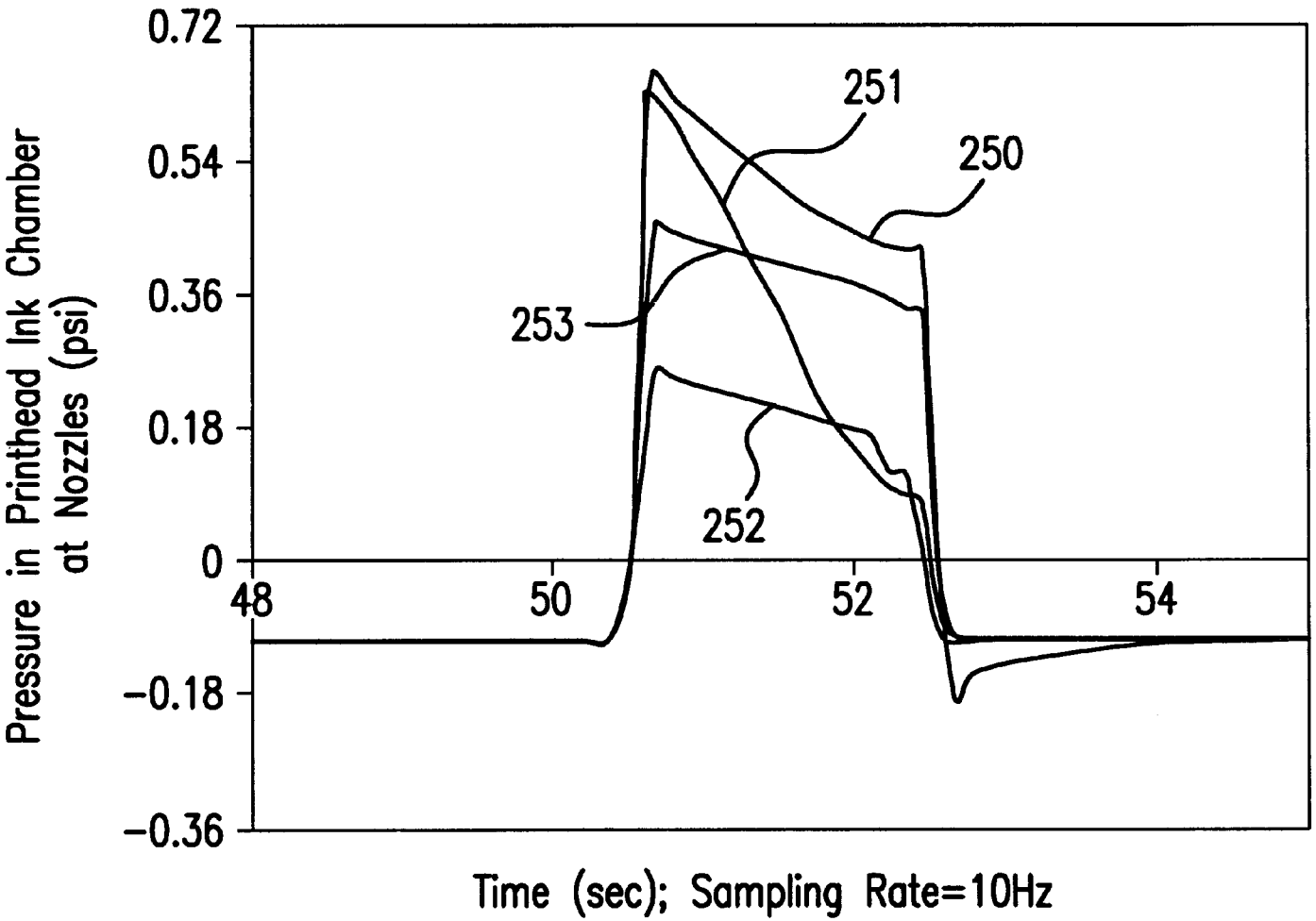
FIG. 30 is a graph of the internal pressure of the ink chamber of a printhead measured close to the nozzle plate during a priming operation carried out with different volumes of air as a function of time for different pressures of ink supplied to the printhead.

FIG. 30 is a graph of the pressure within a black printhead ink chamber 232 measured close to the nozzles during a 2 second prime for different values of the pressure of the ink supplied from the remote reservoirs and for different volumes of primed air. Upper curve 250 was achieved with an injected volume of air of 0.62 cc and an ink supply pressure of 0.4 psi, while curve 251 was achieved with the same volume of injected air but with a slightly negative ink supply pressure of approximately −0.1 psi. As can be seen the initial positive pressure generated within the printhead in both cases is the same (approximately 0.63 psi) but for curve 251 this pressure can be seen to decay more rapidly. From this it can be deduced that the peak in the positive pressure within the printhead is due solely to the air injected and is not substantially affected by the pressure of the ink supply. The rapid pressure decay within the printhead for curve 251 is due to the flow of ink from the printhead towards the remote ink supply. The lower curve 252 was achieved with an injected volume of air of 0.41 cc and an ink supply pressure of 0.9 psi. As can be seen from the peak of curve 252 this ink supply pressure of 0.9 psi is substantially higher than the peak pressure generated within the ink chamber of the printhead (approximately 0.3 psi) and thus flow of ink into the printhead would be expected if these parameters were utilised. The final curve 253 was achieved with an injected volume of air of 0.53 cc and an ink supply pressure of 0.2 psi. This later curve is the most desirable for priming the printhead since it shows little decay in the internal pressure and is likely to represent a good balance of pressures between the ink supply and the priming pressure in order to prevent flow of ink into or out of the printhead from the ink supply reservoirs for this particular printhead. The decay of pressure seen in curve 253 may be due to a loss of air pressure within the positive pressure priming system for example from the piston gasket 69 or from the seal on the printhead holddown cover 36 and/or from the flow of ink onto the nozzle plate of the printhead.

It can also be seen from FIG. 30 that the pressure within the ink chamber prior to priming (approximately −0.11 psi and know as the backpressure) is accurately reestablished by the flexible bag 208 (operating in cooperation with the levers 206, 207 of the printhead) after the priming operation when the bag 208 is once again in contact with atmospheric pressure. A further feature that can be seen from curve 251 of FIG. 30 is that at point 260 of the curve the backpressure within the ink chamber has exceeded i.e. become more negative than the operating point. This is because in this case the ink supply pressure has been set too low i.e. at a slightly negative pressure and this has caused a significant flow of ink out from the printhead towards the remote ink reservoir. Once the operating point of the regulator lever is passed, the regulator valve 227 is opened and ink flows into the printhead until the backpressure returns to −0.11 psi as can be seen in FIG. 30.

The following represents the presently preferred process parameters for performing a printhead service which includes a controlled prime with positive pressure air, spitting while priming and flowback of ink into the printhead.

- perform a cleaning operation on the printhead comprising conventional spitting and wiping
- reduce ink supply pressure from remote reservoirs from 2.1 psi to zero then raise pressure to 0.2 psi
- position pump to inlet of air conduit on carriage cover
- read stored priming parameters for printhead to be primed
- apply pulse warming to heat printhead to 60 C for black printhead and 35 C for color printheads
- actuate pump by carriage movement of 2.67 mm for black printhead to give 0.53 cc of injected air and 0.18 cc of purged ink; and by 2.54 mm for color printheads to give 0.51 cc of injected air and 0.08 cc of purged ink
- hold pump in compressed position and thus hold pressure within air chamber of printhead for 1 second
- fire nozzles for the first 0.5 seconds of the 1 second pressure hold at a frequency of 2 kHz, thus firing 1000 drops per nozzle allow flowback of ink puddle into printhead for 15 seconds perform a second cleaning operation on the printhead comprising conventional spitting and wiping Cleaning of the nozzle plates of the printheads prior to implementing the present servicing technique in which the ink puddle is drawn back into the printhead is important to avoid contaminants which may be on the outer surface of the nozzle plate from being taken into the printhead together with the ink.

Although the majority of the ink puddle has been reabsorbed into the printhead within about 3 seconds after the pump is removed from the inlet of the air conduit on the carriage cover, a further 12 seconds is allowed to enable any remaining waste ink on the nozzle plate to dissolve any dried ink on the nozzle plate prior to performing the second conventional cleaning operation.

It has been found that heating of the printhead (by for example applying pulses of current to heaters within the printhead as is well know in the art) prior to a priming operation is advantageous for a number of reasons. Heating the printhead to a predetermined temperature reduces the variability of the priming process due to ambient temperature variations (if these are not taken into account via the printer sensor 302 as described below). Also it has been found that heating the printhead seems to aid recovery of the printhead from failures due to air bubbles.

Thus heating the ink of the printhead is employed despite the fact that it has also been found in certain cases to reduce the ability of the ink to flowback from the nozzle plate into the printhead due to a reduction in the viscosity of the ink.

As described above the printer comprises a controller 300 which is utilised to control recovery operations for various printheads and which stores the determined optimum parameters for these operations. Since the printer is able to identify specific printheads, different parameters may be stored for example for printheads of different designs or containing ink of different formulations for example dye-based, pigment-based or UV resistant.

Furthermore, the controller in selecting an appropriate set of parameters for a particular printhead may consult a printer mounted sensor 302 to determine the current temperature or humidity and utilise this information to aid in the choice of parameters for the recovery operation.

Persons skilled in the art will understand that the above disclosure of the preferred embodiment of the invention may be modified and that a number of alternatives embodiments are possible within the scope of the invention, for example it will be appreciated that, while the preferred source of gas is a source of a constant volume of gas, the predetermined volume of gas can be supplied from a constant pressure source of gas provided this pressure has been characterised to result in a predetermined increase in the volume of the air chamber of the printhead when said constant pressure source is applied to the air chamber for a characterised period of time.

What is claimed is:

1. A method for priming an inkjet printhead without removing the printhead from a carriage of a printer, the printhead having a body comprising an ink chamber in fluid communication with a plurality of ink ejection nozzles in a nozzle plate and a variable volume air chamber coupled to said ink chamber and having a vent which is in gaseous communication with ambient atmosphere, the method comprising the steps of:

moving the carriage to a service area within the printer, interfacing a source of gas to the vent of the air chamber of the printhead, and delivering a predetermined controlled volume of gas from said gas source at a pressure above ambient atmospheric pressure to the air chamber so that the air chamber expands within the printhead body causing an increase in the pressure within the ink chamber and thus a controlled flow of ink through the nozzles of the printhead to prime the printhead.

2. A method as claimed in claim 1, wherein said controlled flow of ink through the nozzles of the printhead is due substantially only to the expansion of the air chamber.

3. A method as claimed in claim 1, comprising the further step of, subsequent to said delivery of a predetermined controlled volume of gas, maintaining said interface between said source of gas and the printhead vent for a predetermined period of time so as to maintain a pressure above ambient atmospheric pressure within the air chamber for said predetermined period of time.

4. A method as claimed in claim 1 for priming a plurality of printheads mounted within the same carriage, wherein the volume of gas delivered to at least two of said plurality of printheads is different.

5. A method as claimed in claim 1 for priming a plurality of printheads mounted within the same carriage, wherein the duration for which a pressure above ambient pressure is maintained within the air chamber of at least two of said plurality of printheads is different.

6. A method as claimed in claim 1, wherein an insubstantial quantity of ink is lost from the printhead during priming.

7. A method as claimed in claim 6, wherein less than 0.05 cc of ink is lost from the printhead during priming.

8. A method as claimed in claim 1, wherein the printhead further comprises a resilient biasing member within the printhead body which acts to apply a force upon the air chamber in a manner which tends to reduce the volume of the air chamber.

9. A method as claimed in claim 8, wherein during normal printing operation the air chamber serves to maintain a substantially constant pressure within the ink chamber.

10. A method as claimed in claim 9, wherein said substantially constant pressure is below ambient atmospheric pressure.

11. A method as claimed in claim 8, wherein the pressure within the ink chamber subsequent to a priming operation returns to substantially the same pressure existing prior to the priming operation.

12. A method as claimed in claim 8 wherein subsequent to a priming operation a pressure below ambient atmospheric pressure is generated within the ink chamber by the reduction in volume of the air chamber and said pressure acts through the nozzles to draw ink on the outside of the nozzle plate back into the printhead.

13. A method as claimed in claim 1, wherein during priming of the printhead a controlled volume of ink passes through the nozzles onto the outside of the nozzle plate and the majority of said ink is drawn back through the nozzles and into the printhead.

14. A method as claimed in claim 1, wherein the air chamber comprises a flexible bag.

15. A method as claimed in claim 1, wherein the ink chamber comprises an ink regulator through which the ink chamber receives ink from a remote ink reservoir.

16. A method as claimed in claim 15, wherein the remote ink reservoir is pressurised and delivers ink to the ink chamber at a pressure above ambient atmospheric pressure and wherein said ink delivery pressure is controlled during priming of a printhead so that substantially no ink flows into the printhead from the ink reservoir during priming.

17. A method as claimed in claim 15, wherein substantially no ink flows out of the printhead toward the ink reservoir during priming.

18. A method as claimed in claim 15, wherein the ink delivery pressure from the remote ink reservoir is controlled during priming at a pressure which is different from the pressure used during normal printing.

19. A method as claimed in claim 15 for priming a plurality of printheads mounted within the same carriage, wherein the ink delivery pressure from the remote ink reservoir is controlled at a different pressure for at least two of said plurality of printheads.

20. A method as claimed in claim 15, wherein the ink regulator is operatively connected to the air chamber so that changes in the volume of the air chamber during normal printing due to changes in the differential pressure between the internal pressure of the ink chamber and ambient atmospheric pressure cause the air chamber to activate the ink regulator allowing ink to flow from the ink reservoir into the ink chamber of the printhead.

21. A method as claimed in claim 20, wherein expansion of the air chamber during priming of the printhead caused by controlled application of a positive pressure to the vent of the air chamber is controlled so that the ink regulator is substantially not activated and thus substantially no ink enters the ink chamber during priming of the printhead.

22. A method as claimed in claim 1, wherein the nozzles of the printhead are located above a spittoon in the service area of the printer during priming.

23. A method as claimed in claim 1, wherein prior to said step of delivering a predetermined controlled volume of gas to a printhead, said printhead is heated to a predetermined temperature.

24. A method as claimed in claim 23 for priming a plurality of printheads mounted within the same carriage, wherein at least two of said plurality of printheads are heated to a different predetermined temperature.

25. A printer in which an inkjet printhead may be primed without removing the printhead from a carriage of the printer, the printer comprising:

at least one printhead having a body comprising an ink chamber and a variable volume air chamber coupled to said ink chamber, a gas source capable of delivering a predetermined controlled volume of gas at a pressure above ambient pressure, a carriage for holding the at least one printhead and having coupling means for coupling a vent on the printhead to the gas source, and a controller for controlling the priming of the printhead by delivering a predetermined controlled volume of gas from said gas source at a pressure above ambient atmospheric pressure to the air chamber so that the air chamber expands within the printhead body causing an increase in the pressure within the ink chamber and thus a controlled flow of ink through the nozzles of the printhead to prime the printhead.

26. A printer as claimed in claim 25, wherein the controller comprises storage means for storing priming data for use in priming an identified printhead.

27. A printer as claimed in claim 26, wherein the stored priming data comprises data affecting at least one of the following parameters for priming the identified printhead:

a volume of gas supplied to the printhead, a duration for which a pressure above ambient is applied to the printhead, a temperature to which the printhead should be heated prior to priming, an ink supply pressure of a remote ink reservoir in fluid communication with the printhead.

28. A printer as claimed in claim 26, wherein priming data is stored in said storage means for a plurality of printheads and wherein said priming data for at least two of said printheads is different.

29. A printer as claimed in claim 25, wherein the printer further comprises a sensor for measuring at least one environmental parameter and wherein said controller is connected to said sensor and alters the parameters for priming a printhead in dependence on values of said at least one environmental parameter measured by the sensor.

30. A printer as claimed in claim 29, wherein for at least one printhead a plurality of sets of priming parameters are stored in storage means and the controller determines which of said sets to employ in priming said at least one printhead in dependance on one or both of: an ambient temperature value measured by said sensor, an ambient humidity value measured by said sensor.

31. A printer as claimed in claim 25, wherein the source of gas is a mechanically operated air pump.

32. A printer as claimed in claim 31, wherein the mechanically operated air pump is actuated by movement of the carriage.

33. A printer as claimed in claim 25, wherein the source of gas is an electrically operated air pump.

* * * * *